US007703502B2

(12) United States Patent
Wallace et al.

(10) Patent No.: US 7,703,502 B2
(45) Date of Patent: Apr. 27, 2010

(54) METHOD OF FABRICATING A LONGITUDINAL FRAME MEMBER OF A TRENCH-FORMING ASSEMBLY

(75) Inventors: Timothy Harold Wallace, Charlotte, NC (US); Barry Clifton Williams, Statesville, NC (US)

(73) Assignee: ABT, Inc., Troutman, NC (US)

( * ) Notice: Subject to any disclaimer, the term of this patent is extended or adjusted under 35 U.S.C. 154(b) by 959 days.

(21) Appl. No.: 11/170,695

(22) Filed: Jun. 29, 2005

(65) Prior Publication Data

US 2005/0238436 A1 Oct. 27, 2005

Related U.S. Application Data

(62) Division of application No. 10/282,517, filed on Oct. 29, 2002, now Pat. No. 6,926,245.

(51) Int. Cl.
*B22D 17/00* (2006.01)
*B22D 25/02* (2006.01)

(52) U.S. Cl. ..... 164/113; 164/459; 52/837; 52/846; 249/11; 405/118; 428/587; 428/598; 428/603

(58) Field of Classification Search ..... 29/33 C, 29/DIG. 47; 405/118, 119; 249/11, 219.1, 249/10; 52/837, 831, 846; 72/260; 164/113, 164/459, 465; 264/177.1, 177.11; 428/587, 428/598, 603

See application file for complete search history.

(56) References Cited

U.S. PATENT DOCUMENTS

| | | | |
|---|---|---|---|
| 386,768 | A | 7/1888 | Burrows |
| 1,637,998 | A | 8/1927 | Heitzel |
| 2,635,320 | A | 4/1953 | Omitz |
| 2,727,294 | A | 12/1955 | Arrighini |
| 3,207,465 | A | 9/1965 | Papin |
| 3,422,585 | A | 1/1969 | Dismukes |
| 3,712,576 | A | 1/1973 | Dagiel |
| 3,722,849 | A | 3/1973 | Luyben |
| 4,066,237 | A | 1/1978 | Bentz |

(Continued)

FOREIGN PATENT DOCUMENTS

| | | |
|---|---|---|
| CH | 588 597 | 6/1977 |

(Continued)

OTHER PUBLICATIONS

Examiner's Report for EP 03022777.1-1255 dated Jul. 30, 2008.

*Primary Examiner*—Erica E Cadugan
(74) *Attorney, Agent, or Firm*—Henry B. Ward, III; Moore & Van Allen

(57) ABSTRACT

An assembly is provided for forming a trench of a predetermined shape. The trench-forming assembly includes a removable longitudinal form body, a pair of frame members and at least one mounting bracket assembly. The form body is capable of shaping a moldable trench forming composition poured around the form. Each frame member includes a support surface, and is in engagement with a respective side surface of the form body. The mounting bracket assemblies, each of which can include a mounting bracket and a pair of hook members, extend laterally across the top surface of the form body. In this regard, each mounting bracket assembly removably engages a downwardly facing side of the support surface of the frame members.

7 Claims, 14 Drawing Sheets

U.S. PATENT DOCUMENTS 4,319,438 A * 3/1982 Mikajiri ..... 52/220.5
4,498,807 A * 2/1985 Kirkpatrick et al. ..... 405/43
4,536,103 A 8/1985 Prescott
4,640,643 A * 2/1987 Williams ..... 405/118
4,751,945 A * 6/1988 Williams ..... 405/118
4,844,655 A 7/1989 Aleshire
4,993,877 A 2/1991 Beamer
4,993,878 A 2/1991 Beamer
5,000,621 A 3/1991 Beamer
5,066,165 A 11/1991 Wofford et al.
5,256,000 A 10/1993 Beamer
5,281,051 A 1/1994 Stegall
5,281,052 A 1/1994 Beamer
5,348,421 A 9/1994 Stegall
5,393,171 A 2/1995 Stegall
5,399,047 A 3/1995 Stegall
5,478,169 A 12/1995 Stegall
5,522,675 A 6/1996 Gunter
5,538,361 A 7/1996 Beamer
5,568,995 A 10/1996 Beamer
5,573,351 A 11/1996 Beamer
5,613,804 A 3/1997 Beamer
5,702,204 A 12/1997 Gunter
5,735,637 A * 4/1998 Gunter ..... 405/118
5,890,839 A 4/1999 Gunter
6,004,068 A 12/1999 Hosley
6,220,784 B1 4/2001 Bricker
6,234,447 B1 5/2001 Boyden et al.
6,443,656 B1 9/2002 Gunter
6,468,613 B1 * 10/2002 Kitano et al. ..... 428/35.8
6,533,497 B2 3/2003 Gunter
6,663,317 B1 * 12/2003 Williams et al. ..... 405/48
2002/0154952 A1 10/2002 Gunter

FOREIGN PATENT DOCUMENTS

DE 853962 10/1952
DE 3018331 11/1981
DE 9005204.8 U1 8/1990
GB 1 181 175 A 4/1987
WO WO-99/10168 A1 * 3/1999

* cited by examiner

METHOD OF FABRICATING A LONGITUDINAL FRAME MEMBER OF A TRENCH-FORMING ASSEMBLY

CROSS REFERENCE TO RELATED APPLICATIONS

This application is a Divisional of Ser. No. 10/282,517 now U.S. Pat. No. 6,926,245, filed Oct. 29, 2002, which is hereby incorporated herein in its entirety by reference.

FIELD OF THE INVENTION

The present invention relates generally to systems and methods for forming a trench and, more particularly, relates to a mounting bracket assembly for connecting frame members of a trench-forming assembly and an associated method of fabricating frame members.

BACKGROUND OF THE INVENTION

Drainage and other trenches of various sizes and shapes are desirable for a number of applications. For example, manufacturing facilities typically require drainage systems that include trenches formed in the building floors to collect, remove, and/or recycle excess water or other liquids. These trenches may also be used as utility chases to provide temporary or permanent routing of electrical lines, pipes, conduits or the like below the level of the building floor. In addition, numerous outdoor industrial and commercial sites, such as parking lots, also require drainage systems, including trenches, to collect and direct rainwater and other liquids to underground storm sewers to prevent flooding and to decrease run-off. Similarly, roadways and the like may also require drainage systems, including trenches.

In the past, these trenches have generally been formed by first placing and securing a form of predetermined shape in a ditch that has previously been formed in the ground. A moldable trench forming composition, such as cementitious material, is then poured around the form and is allowed to set. Once the cementitious material has set, the form is removed from the resulting trench.

One type of form assembly used to define a trench includes a wooden form and strut structure. The wooden form includes a wooden frame which is covered with wooden sheets or planks to define a generally rectangular elongated trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Cementitious material is typically poured up to the bottom face of the form and allowed to set in order to anchor the wooden form in the ditch. Then, additional cementitious material is poured between the earthen walls of the ditch and the wooden sides of the form. Once all of the cementitious material has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

Commercially significant methods for forming trenches, together with improved removable forms for forming trenches, are disclosed in U.S. Pat. No. 5,281,051, which is assigned to the assignee of the present invention and incorporated herein by reference. In advantageous embodiments thereof, inexpensive forms are employed to form trenches instead of using the wooden forms discussed above. The trench-forming assembly disclosed in U.S. Pat. No. 5,281,051 preferably includes opposing longitudinal frame members having a plurality of anchoring rods extending downwardly from the frame members. An elongated form body, preferably formed of relatively lightweight expanded polystyrene, includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation.

Preferably the assembled form and frame members are placed into a prepared ditch by suspending the assembly from its top, such as by one or more batter boards. Cementitious material is first poured around the bottom of the anchoring legs attached to the frame members and allowed to set in order to anchor the anchoring legs and, in turn, the frame members and the form within the ditch. Then more cementitious material is poured around the form body and allowed to set. Finally the form body is removed to expose the resulting trench and the properly aligned frame members. The removal of the form may be facilitated by a pair of slots extending upwardly into the form body from its bottom surface. By removing an upper portion of the form to access the slots as shown in U.S. Pat. No. 5,281,051, the form body can be more easily removed from the trench in several pieces.

Regardless of the fabrication technique, it is normally desirable to finish the trench with an elongated grate covering its open top in order to prevent people from unwittingly stepping in the open trench, to provide a smooth surface for vehicle travel, and/or to prevent relatively large objects from entering the trench and potentially blocking the flow of liquid therethrough. For a trench formed and described by U.S. Pat. No. 5,281,051, the grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the frame members and, in turn, the grate are not properly aligned, the grate, the frame members and/or the cementitious trench itself may be damaged by the resulting movement of the grate. Accordingly, the alignment of the frame members in the moldable trench forming composition is important.

As shown by U.S. Pat. No. 5,348,421, which is assigned to the assignee of the present invention and incorporated herein by reference, the frame members may be connected by generally U-shaped members. While the U-shaped members generally maintain the frame members in position with respect to one another, the frame members are still able to move somewhat with respect to one another. Such relative movement is typically undesirable since it may adversely alter the relative alignment of the frame members such that the grate no longer sits evenly upon the rails. As such, one or more tie wires have been conventionally utilized to secure the frame members to the form. In this regard, the tie wires generally wrap about the opposed frame members so as to bring the frame members into snug contact with the opposite sides of the form. Once the cementitious material has set and the frame members are correspondingly affixed in position, the tie wires can be removed prior to removing the form to expose the resulting trench. And while tire wires are adequate for securing the frame members to the form, it is typically desirous to improve the method by which frame members are secured to the form.

SUMMARY OF THE INVENTION

The present invention provides an improved trench-forming assembly and method of forming a trench, where the trench-forming assembly includes one or more mounting bracket assemblies. In this regard, the mounting bracket assemblies are capable of extending across a form body of the trench-forming assembly such that the mounting bracket assembly can be removably engaged with the frame members of the trench-forming assembly when the frame members are engaged with the form body. As such, the trench-forming assembly can bring the frame members into snug contact with opposite sides of the form body to thereby reduce lateral movement of the frame members with respect to the form body. In addition, the mounting bracket assembly can extend beyond the form body. Advantageously, then, the form body and frame members can be suspended from the mounting bracket assembly, when the form body and frame members are placed in a ditch, such as during formation of a trench.

According to one aspect of the present invention, an assembly is provided for forming a trench of a predetermined shape. The trench-forming assembly includes a removable longitudinal form body, a pair of frame members and at least one mounting bracket assembly. The form body is capable of shaping a moldable trench forming composition poured around the form, where the form includes a bottom surface, a top surface and opposed side surfaces and defines the predetermined shape of the trench. Each frame member is in engagement with a respective side surface of the form body. Also, each frame member includes a support surface for supporting a trench cover. The trench-forming assembly can also include a plurality of anchoring legs affixed to the frame members and extending downwardly therefrom.

The mounting bracket assemblies extend laterally across the top surface of the form body. In this regard, each mounting bracket assembly removably engages a downwardly facing side of the support surface of the frame members. More particularly, each mounting bracket assembly can include a mounting bracket and a pair of hook members. The mounting bracket can extend laterally across the top surface of the form body. The hook members, which are capable of being carried by the mounting bracket, can then be removably engaged with a downwardly facing surface of a respective frame member. Each mounting bracket can also include a pair of tension members capable of urging respective hook members into contact with the downwardly facing surface of the horizontal leg of respective frame member.

In one embodiment, the pair of hook members define slots therethrough, and the pair of tension members comprise a pair of wedge members. The wedge members can extend through the slots defined by respective hook members to thereby secure the hook members in engagement with the downwardly facing surfaces of the frame members. In such embodiments, each mounting bracket can include a horizontally oriented leg that defines a pair of apertures therethrough and that extends across the form body. In this regard, each hook member can extend at least partially though a respective aperture. Also in such embodiments, the slot defined by each hook member faces the other such that the wedge members can extend through the slots. Further, the wedge members can slidably rest on a surface of the horizontally oriented leg opposite the form body. As such, the wedge members are capable of extending through the slots in varying amounts to secure the hook members in engagement with the downwardly facing surfaces of the horizontal legs of the frame members.

In another embodiment, the pair of hook members of each mounting bracket are pivotably secured to the respective mounting bracket. And in yet another embodiment, each hook member includes a downwardly extending member extending from a downwardly facing surface of the mounting bracket and a button member affixed to the downwardly extending member. The button member, in turn, can engage the downwardly facing surfaces of the horizontal legs of respective frame members.

According to various advantageous embodiments, the mounting bracket assembly can include a pair of downturned bias members that extend downward from the mounting bracket assembly. In such embodiments, the downturned bias members are capable of effectively contacting upwardly facing surfaces of the horizontal legs of respective frame members when the mounting bracket assembly engages the downwardly facing surfaces of the horizontal legs of respective frame members. According to other advantageous embodiments, the mounting bracket assembly can extend laterally beyond the form body and frame members. In this regard, the form body and frame members can be placed into a prepared ditch by suspending the form body and frame members from the mounting bracket assembly.

In one particular embodiment, each frame member includes an elongate vertically oriented leg, an elongate horizontally oriented leg, an end member and a securing leg. The horizontal leg is affixed along a top edge of the vertical leg and, in turn, the end member is affixed along an edge of the horizontal leg opposite the form body. The horizontal leg defines a support surface, and can engage the form body. The securing leg is affixed along a bottom edge of the vertical leg, and includes a portion capable of engaging the form body while a portion of the horizontal leg engages the form body.

In one advantageous embodiment, the horizontal leg and the securing leg are integral with the vertical leg, and the end member is integral with the horizontal leg. Thus, according to another aspect of the present invention, a method is provided for fabricating a longitudinal frame member of a trench-forming assembly. The method begins by providing a molten material. Then, the molten material is extruded through a die shaped to define the frame member which advantageously has the same profile along its entire length, namely, a vertical leg, a horizontal leg and a securing leg integral with opposing edges of the vertical leg, and an end member integral with an edge of the horizontal leg. More particularly, the molten material can be extruded through a die shaped to define the horizontal leg to include an engagement portion and a support portion that extend outwardly from a top edge of the vertical leg in opposing directions. The molten material can also be extruded through a die shaped to define the securing leg to includes an engagement portion, and includes a connecting portion that extends at least one of downwardly and outwardly from a bottom edge of the vertical leg in opposing directions. Further, the molten material can be extruded through a die shaped to define the end member to include an edge portion and a base portion that extends outwardly from an edge of the support portion. In addition, the die can be shaped such that extruding the molten material through the die defines the horizontal leg and securing leg to each include an engagement portion that extend outwardly from a respective edge of the vertical leg such that the engagement portions are adapted to engage a form body of the trench-forming assembly. Moreover, by extruding the frame member, the frame member can be formed in an economic manner.

According to yet another aspect of the present invention, a method is provided for forming a trench of a predetermined shape. According to the method, a trench-forming assembly is provided, where the trench-forming assembly again comprises a removable longitudinal form body including a top surface, a bottom surface and opposed side surfaces, and defining the predetermined shape. The trench-forming assembly also includes a pair of longitudinal frame members in engagement with respective side surfaces of the form body, where each frame member includes a support surface. The method continues by extending at least one mounting bracket assembly laterally across the top surface of the form body and thereafter removably engaging each mounting bracket assembly with a downwardly facing side of the support surfaces of the frame members. Advantageously, the mounting bracket assembly extends beyond the form body and frame members. In embodiments where the mounting bracket assembly includes a pair of downturned bias members, each mounting bracket assembly can be engaged such that the downturned bias members effectively contact upwardly facing surfaces of respective frame members.

The mounting bracket assembly can engage the frame members in various manners. In embodiments where each mounting bracket assembly includes a pair of hook members, each mounting bracket assembly can be engaged by engaging a downwardly facing side of the support surface of each frame member with a respective hook member. Also, in embodiments where the mounting bracket assembly includes tension members, each mounting bracket assembly can be engaged by moving the tension members to thereby urge the hook members into contact with the downwardly facing sides of the support surfaces of respective frame members. Further, where the hook members define slots and the pair of tension members comprise a pair of wedge members, engaging each mounting bracket assembly can further include extending each wedge member through a slot defined by a respective hook member to thereby secure the hook members in engagement with the downwardly facing sides of the support surfaces of the frame members.

In embodiments where the hook members of the mounting bracket assembly are pivotably secured to the mounting bracket, each mounting bracket assembly can be engaged by pivoting a hook portion of each hook member underneath the downwardly facing side of the support surface of a respective frame member. Alternatively, in embodiments where each hook member includes a vertically oriented member extending downward from a bottom surface of the mounting bracket and a button member affixed to the vertically oriented member, each mounting bracket assembly can be engaged by pressing the mounting bracket assembly into contact with the top surface of the form body and frame members. As the mounting brackets are pressed into contact, then, the vertically oriented members resiliently bend from an original form as the button members contact side surfaces of respective frame members. Thereafter, the vertically oriented members return to the original form as the button members engage the downwardly facing surfaces of the horizontal legs of the respective frame members.

After the mounting bracket assembly has been extended across the form body, the trench-forming assembly is placed into a prepared ditch by suspending the form body and frame members from the mounting bracket assembly. Then, a moldable trench-forming composition is poured around at least portions of the trench-forming assembly to form the trench of predetermined shape. Before pouring the moldable trench-forming composition, however, the trench-forming assembly can be anchored in the ditch. Following pouring the moldable trench-forming composition, each mounting bracket assembly can be disengaged from the frame members. More particularly, the moldable trench-forming composition can be poured around the bottom and side surfaces of the form body, such as up to and partially surrounding the mounting bracket assemblies, after which each mounting bracket assembly can be disengaged before the moldable trench-forming composition sets around upper portions of the side surfaces of the form body.

BRIEF DESCRIPTION OF THE DRAWINGS

Figure 1:
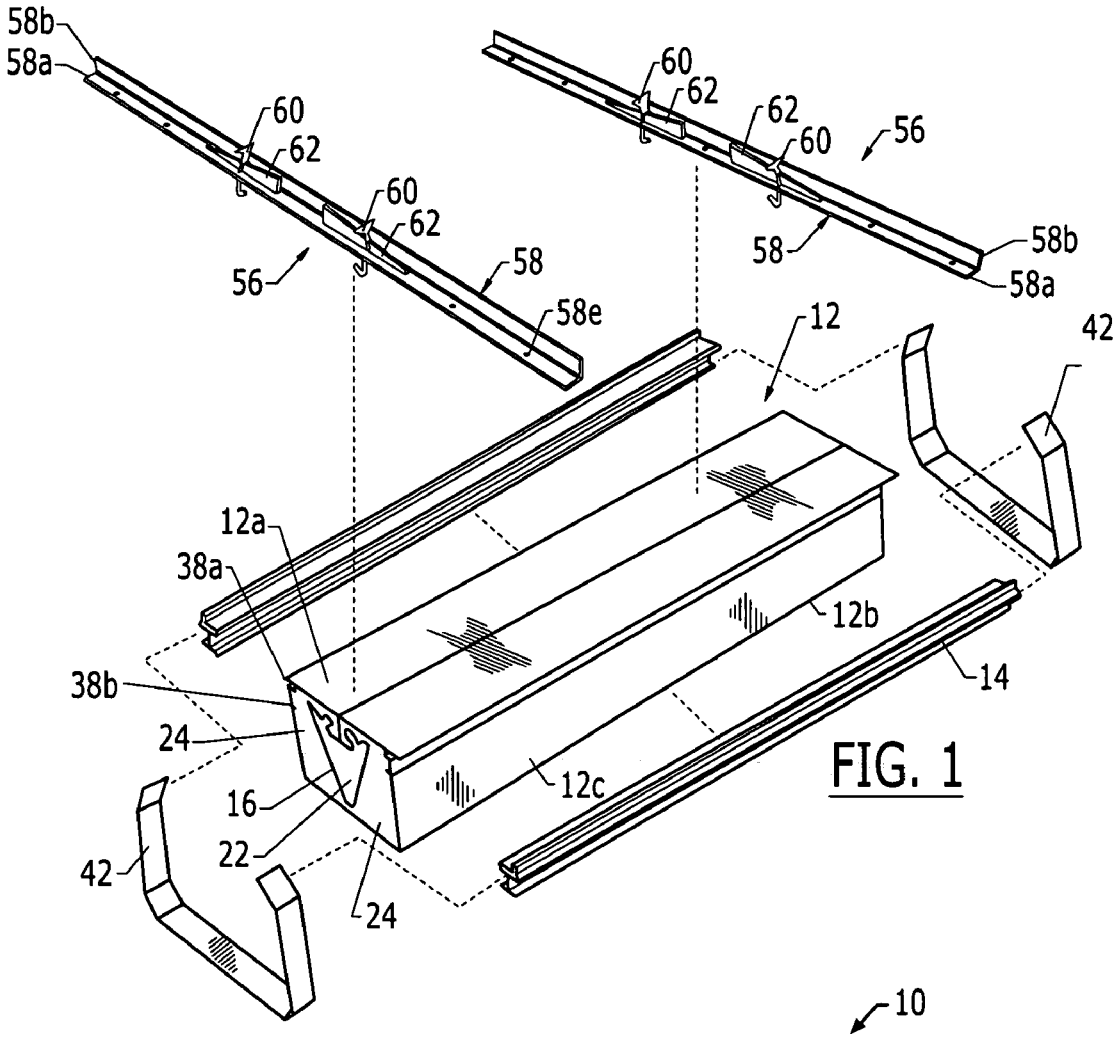
Figure 2:
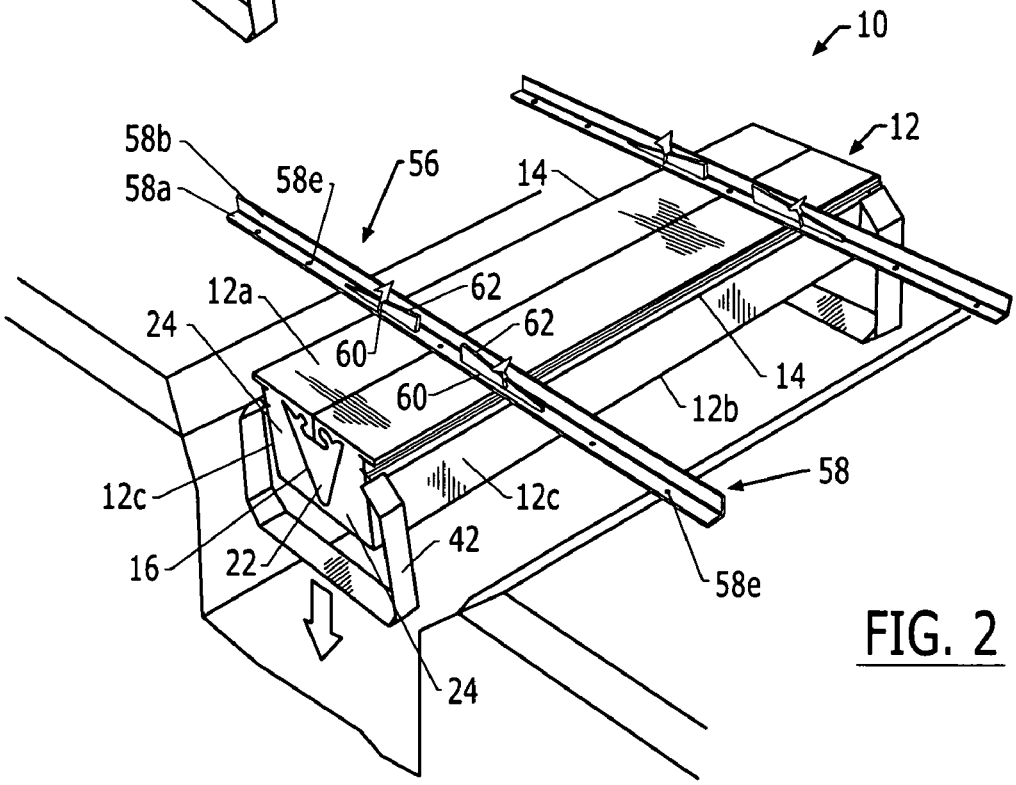
Figure 3:
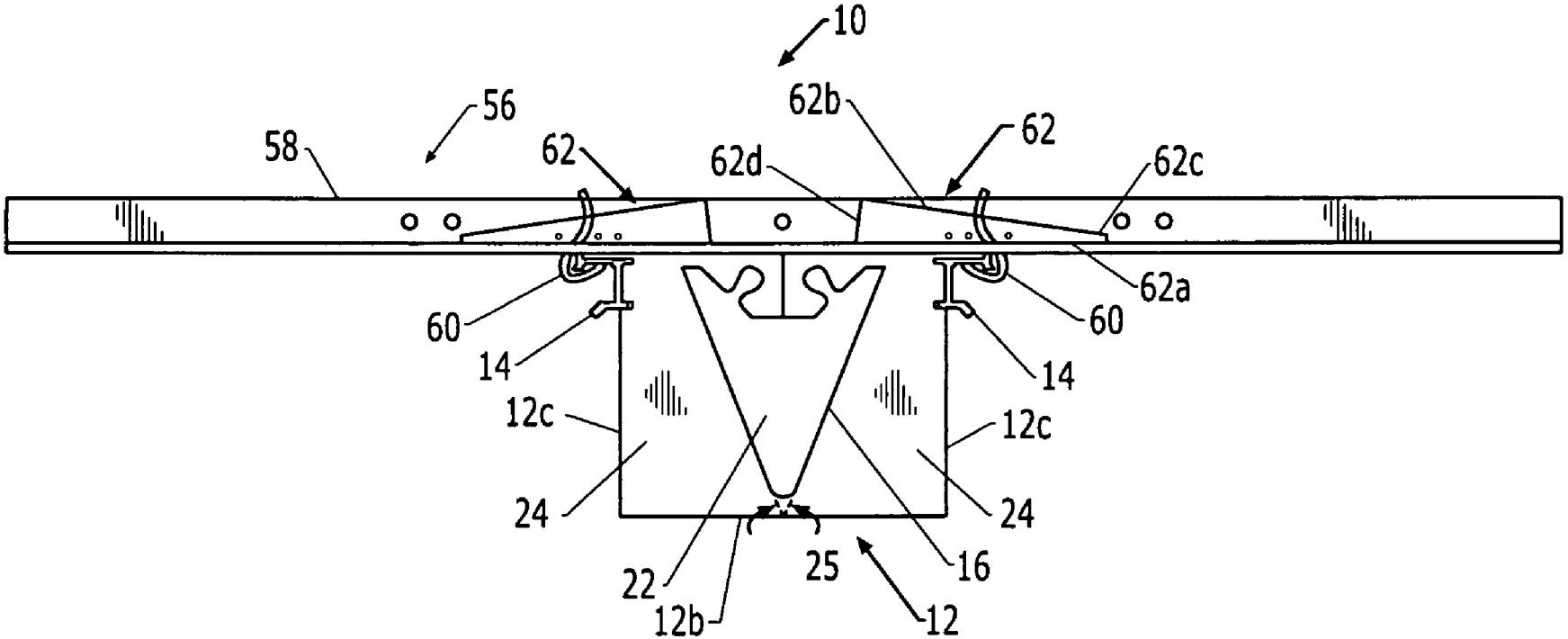
Figure 4A:
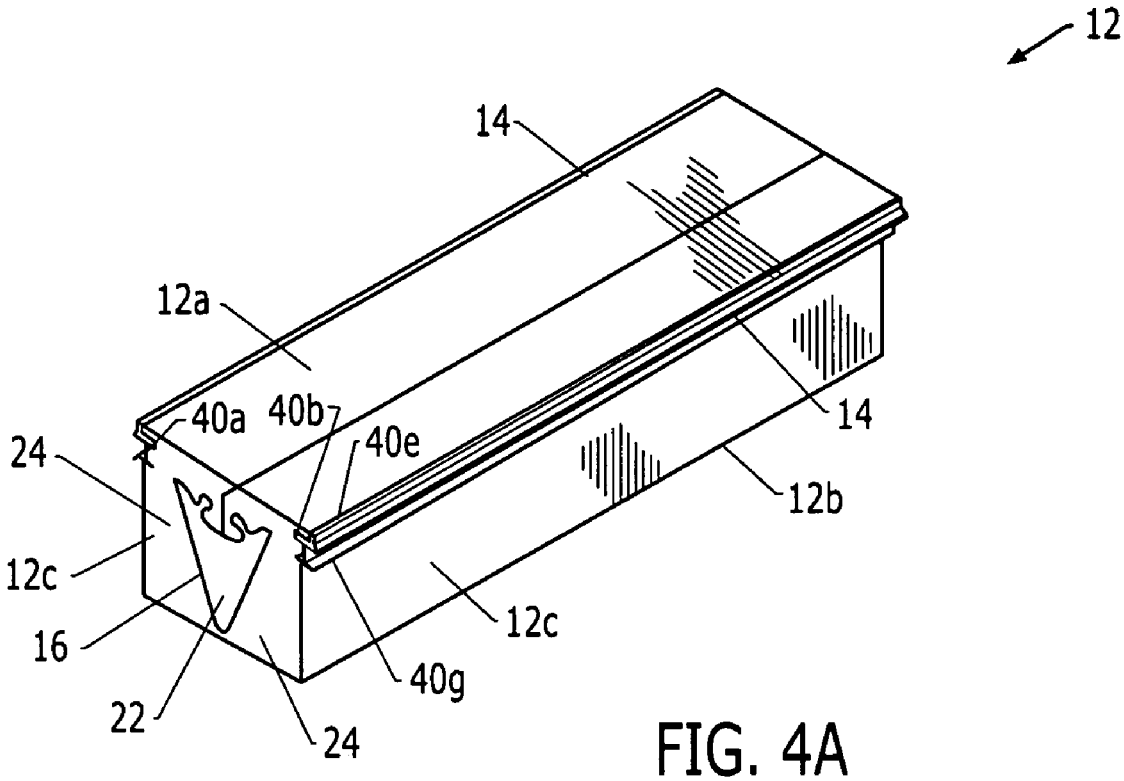
Figure 4B:
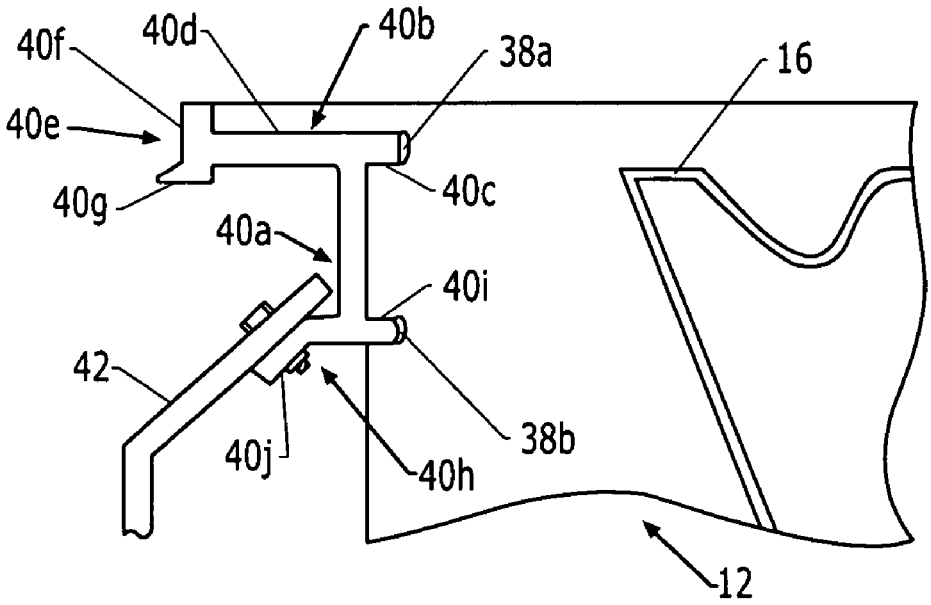
Figure 5A:
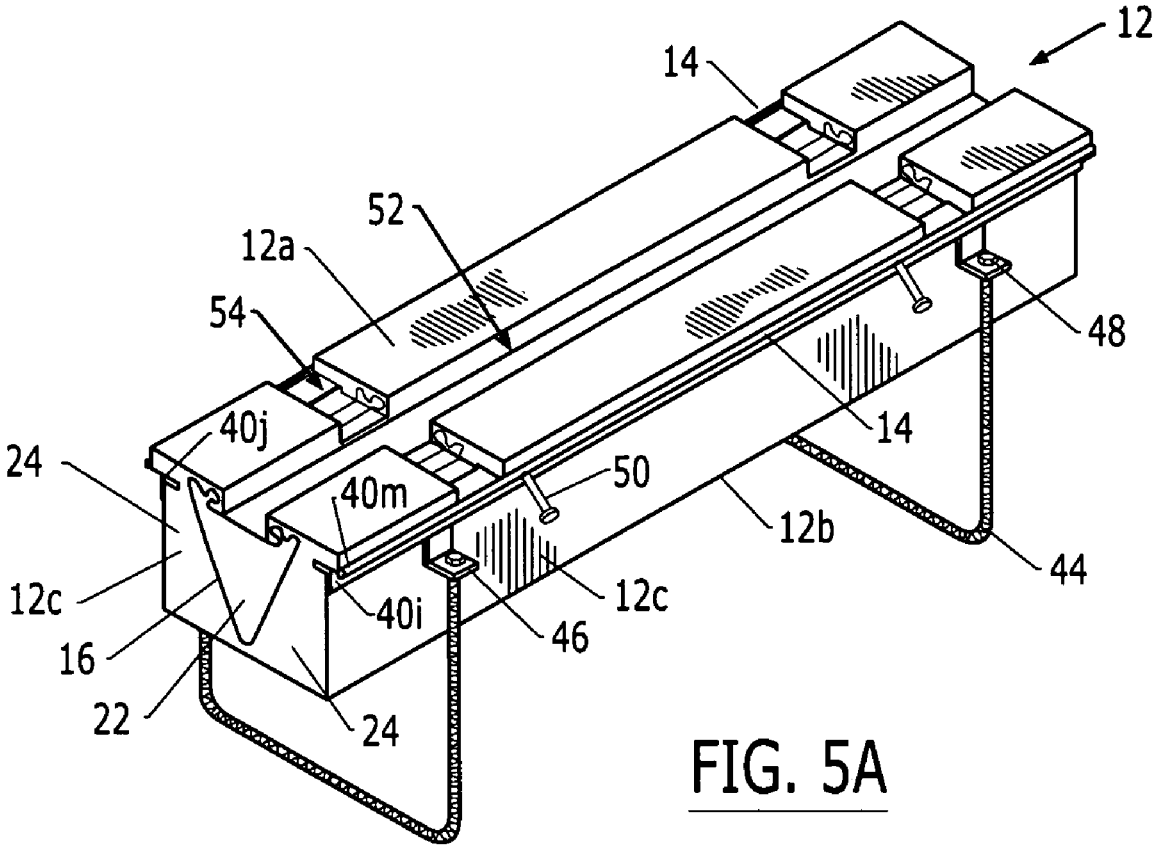
Figure 5B:
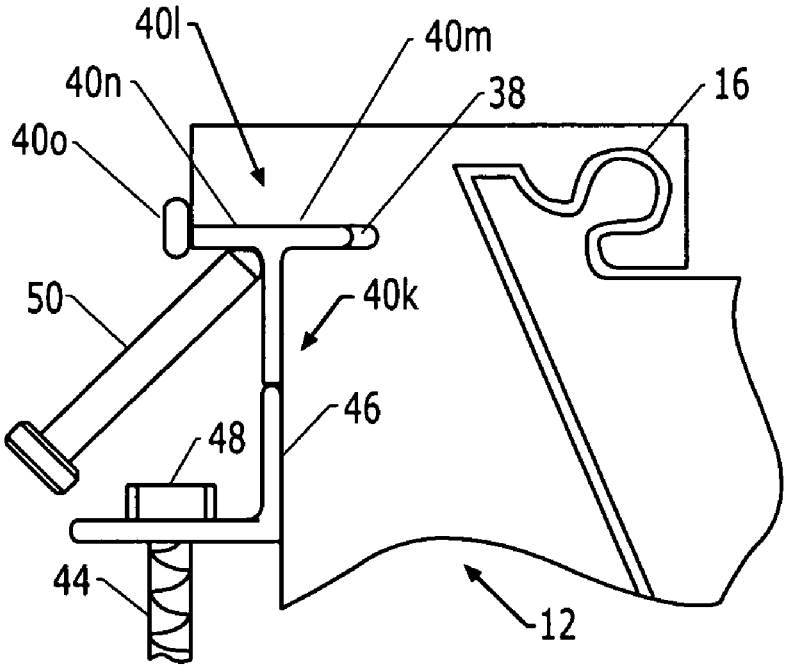
Figure 6A:
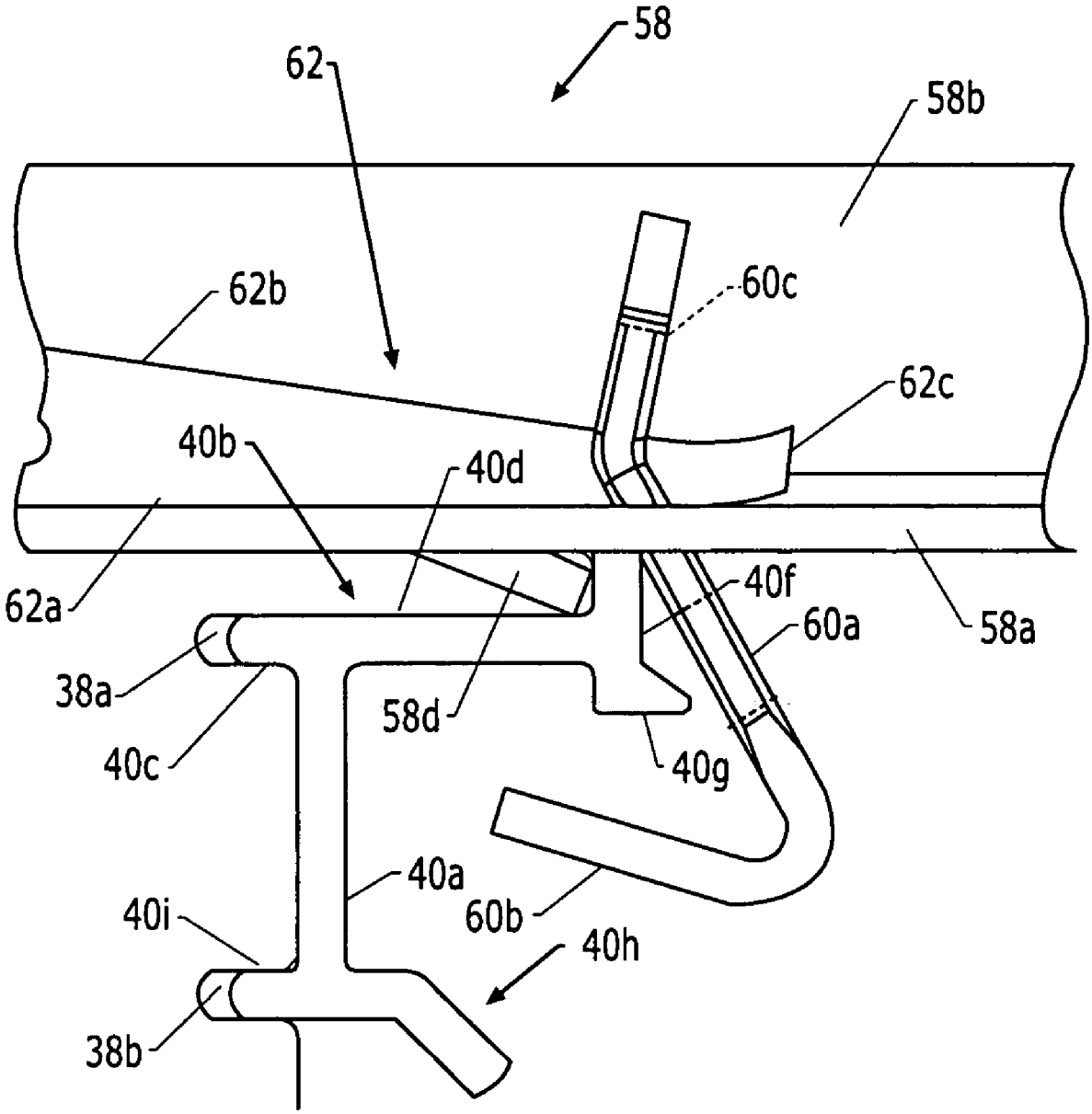
Figure 6B:
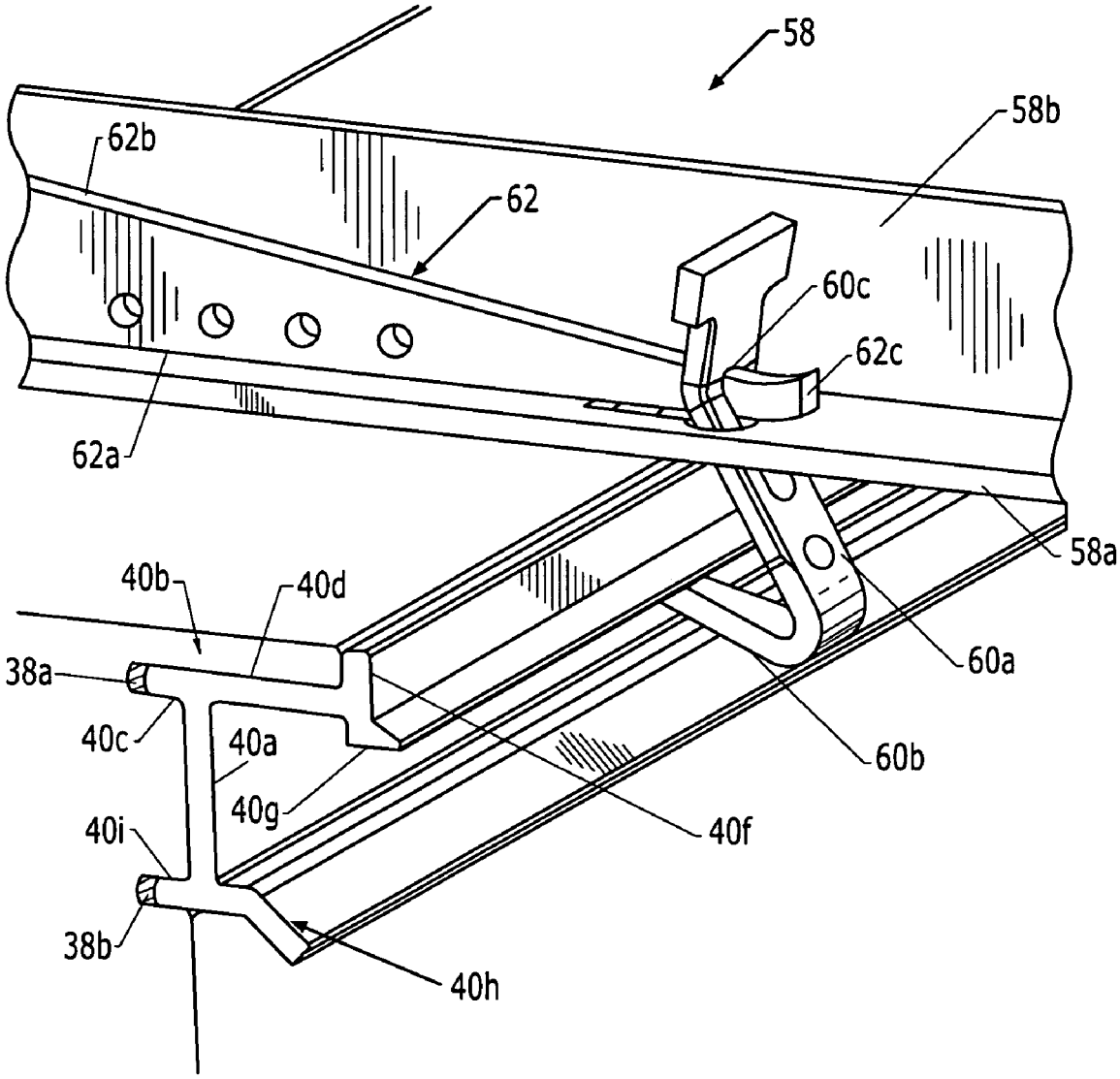
Figure 7A:
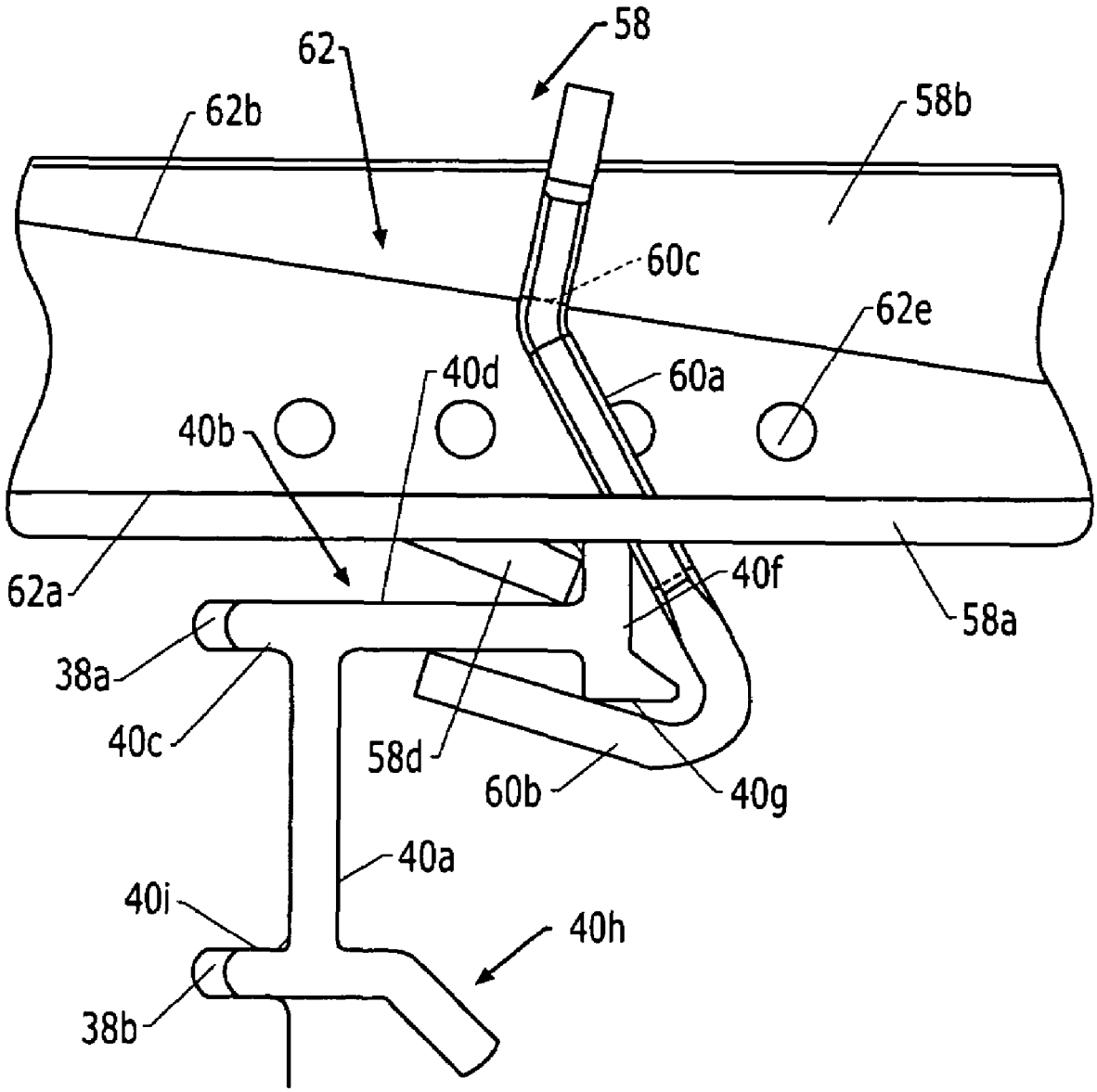
Figure 7B:
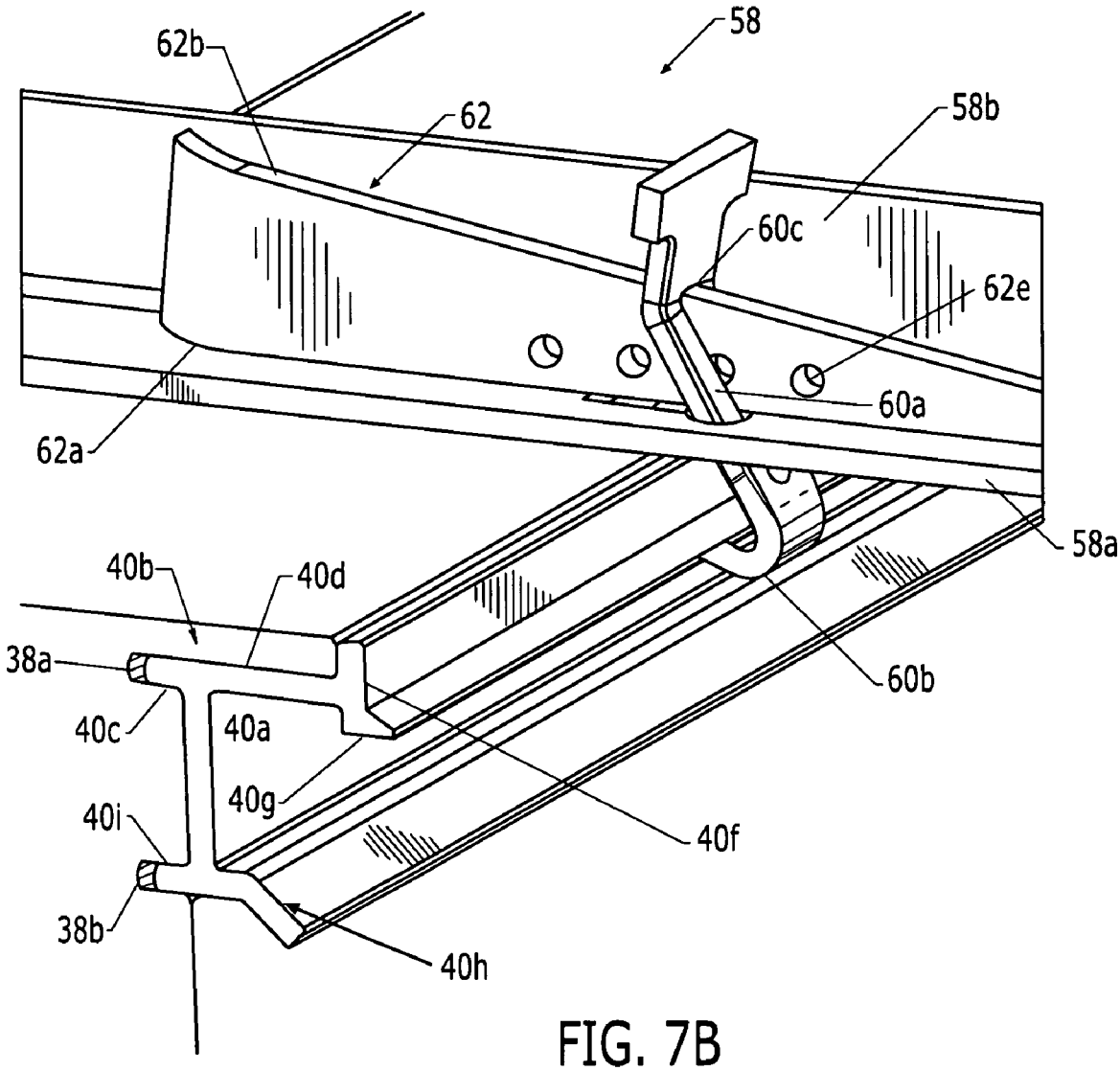
Figure 8A:
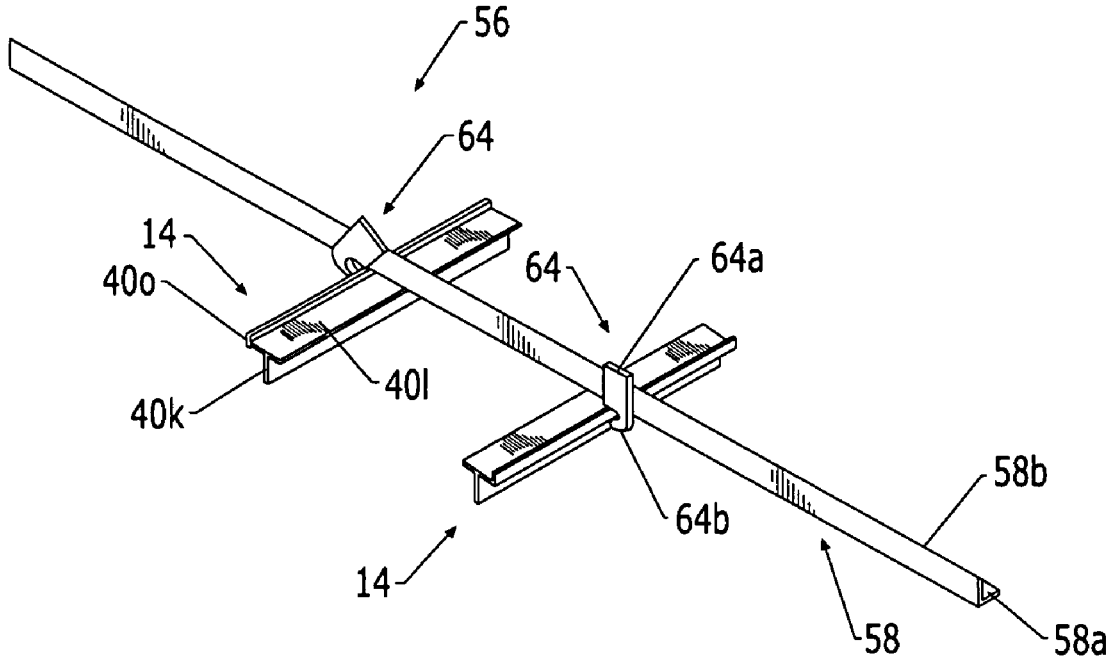
Figure 8B:
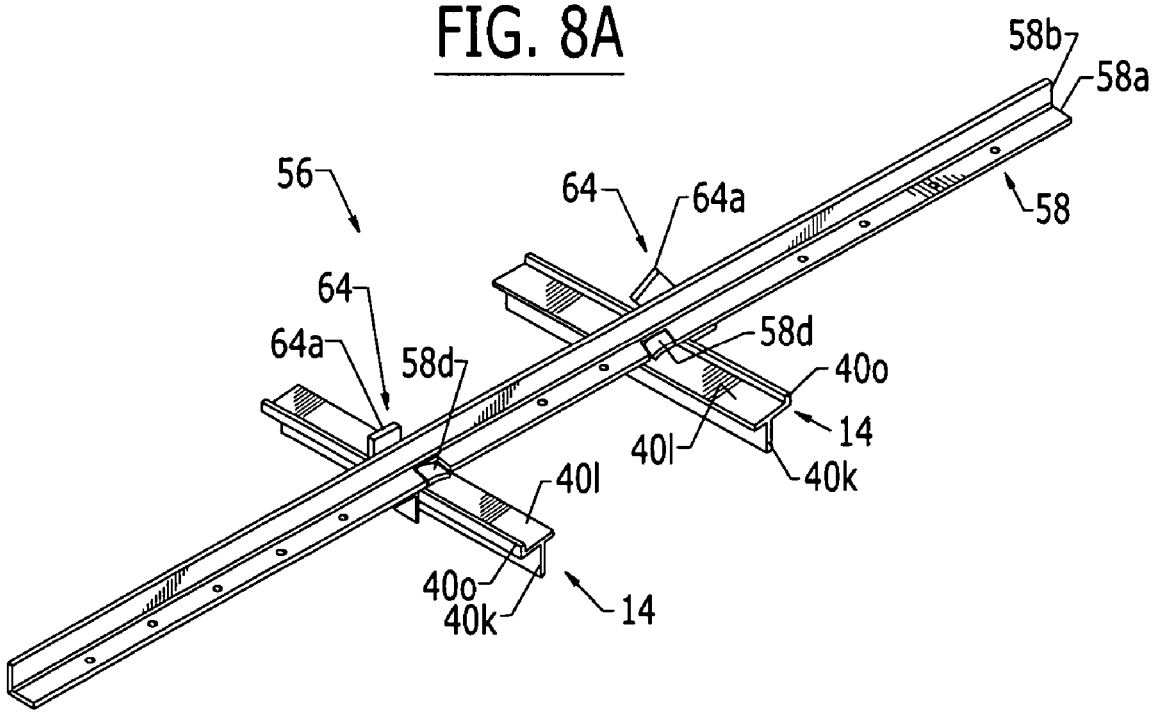
Figure 9:
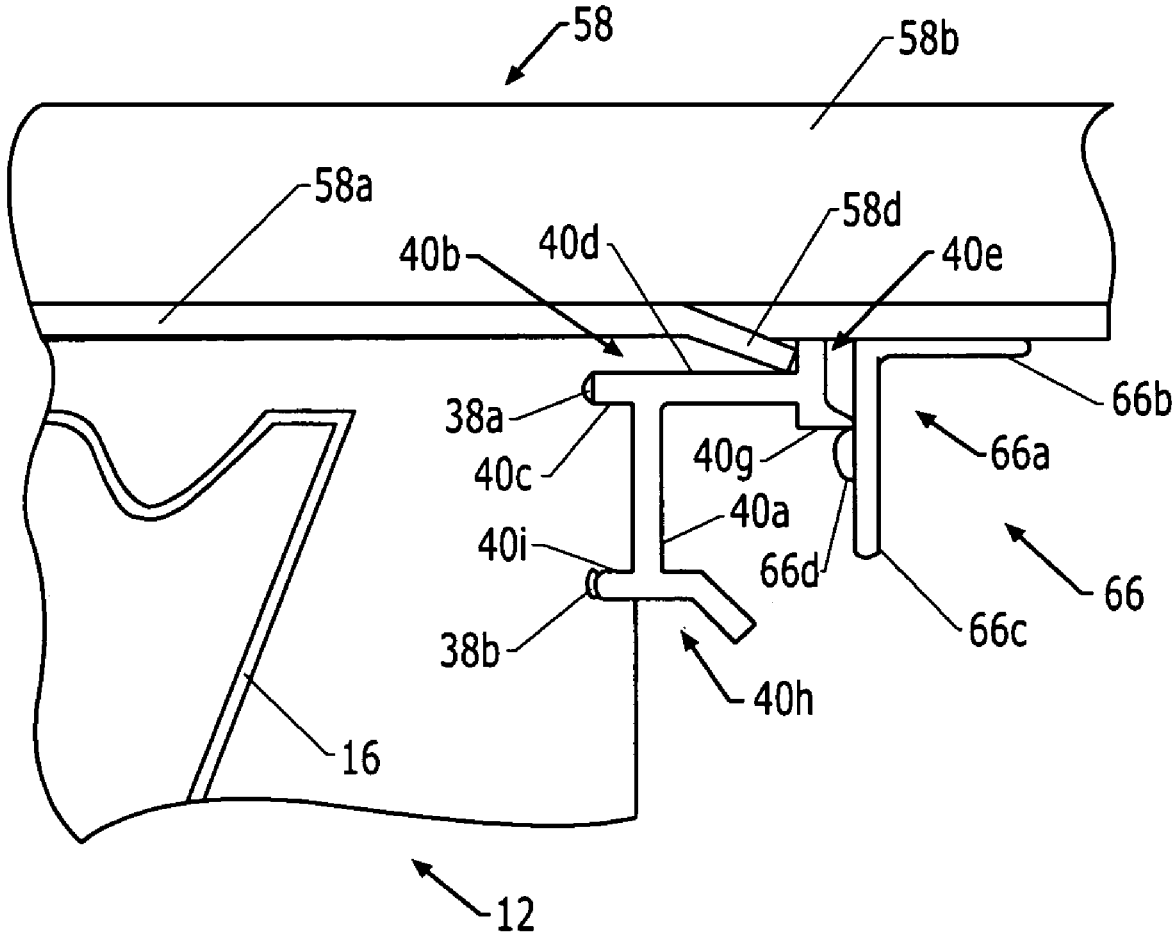
Figure 10:
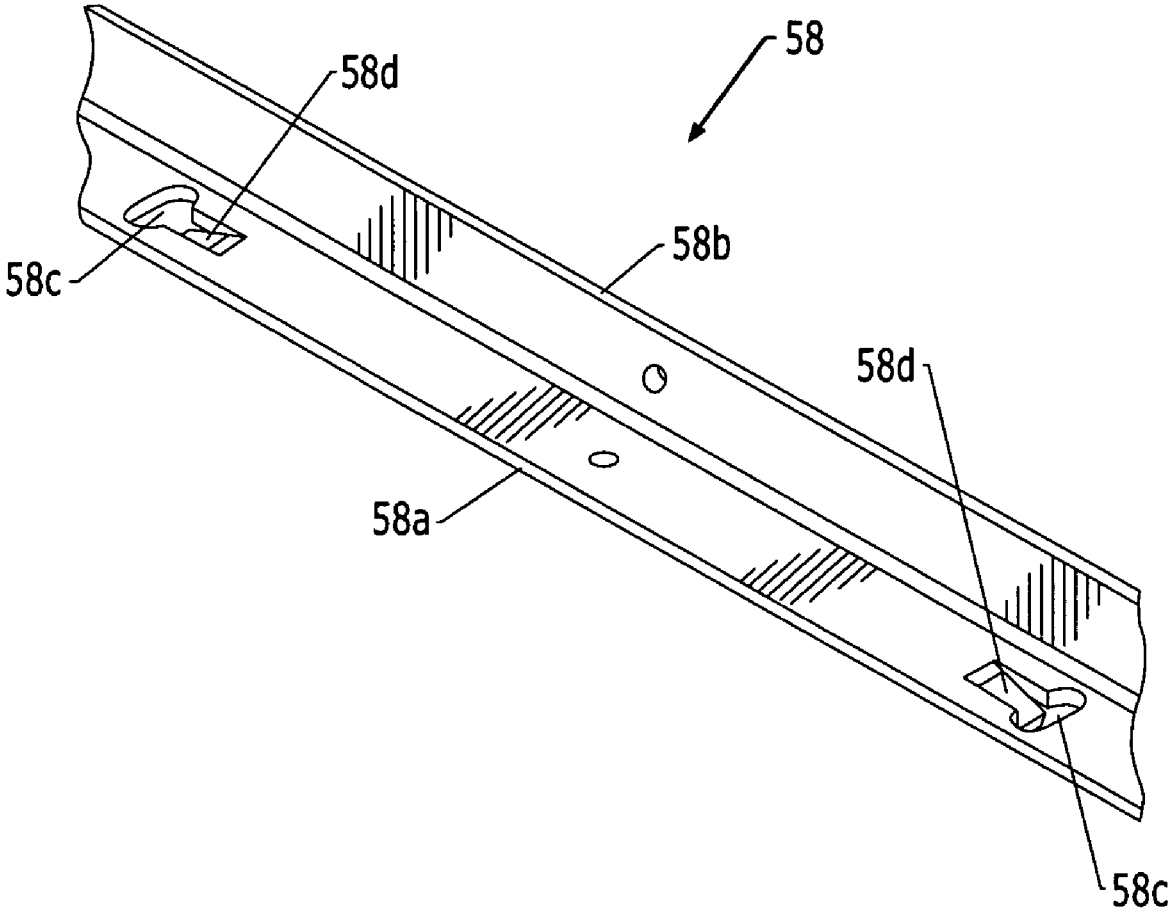
Figure 11:
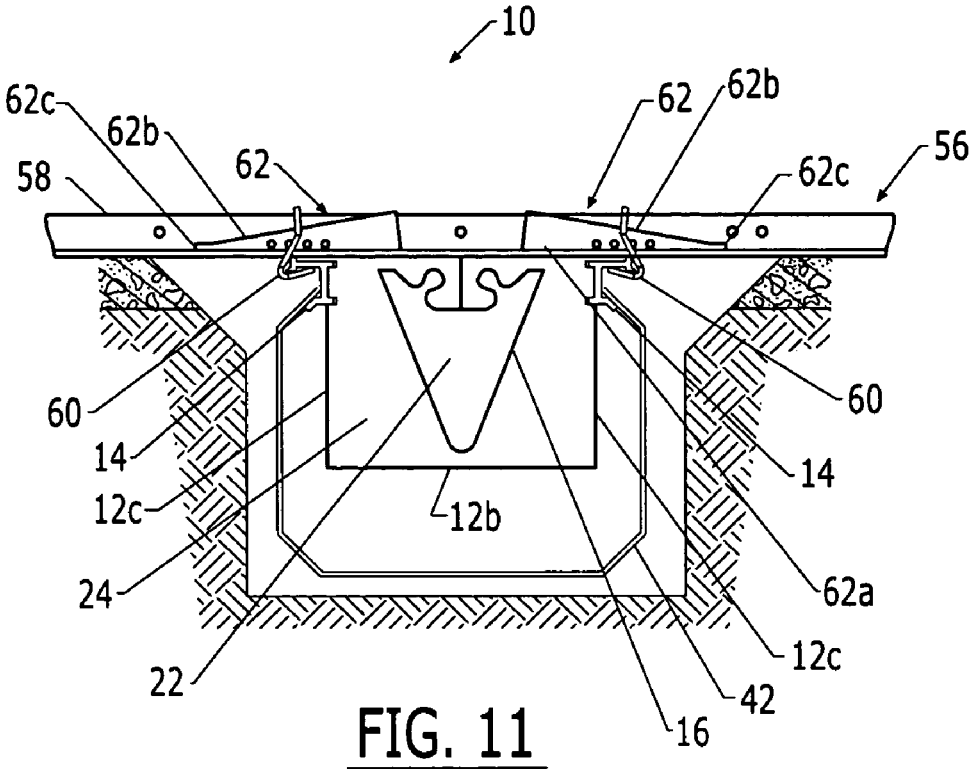
Figure 12:
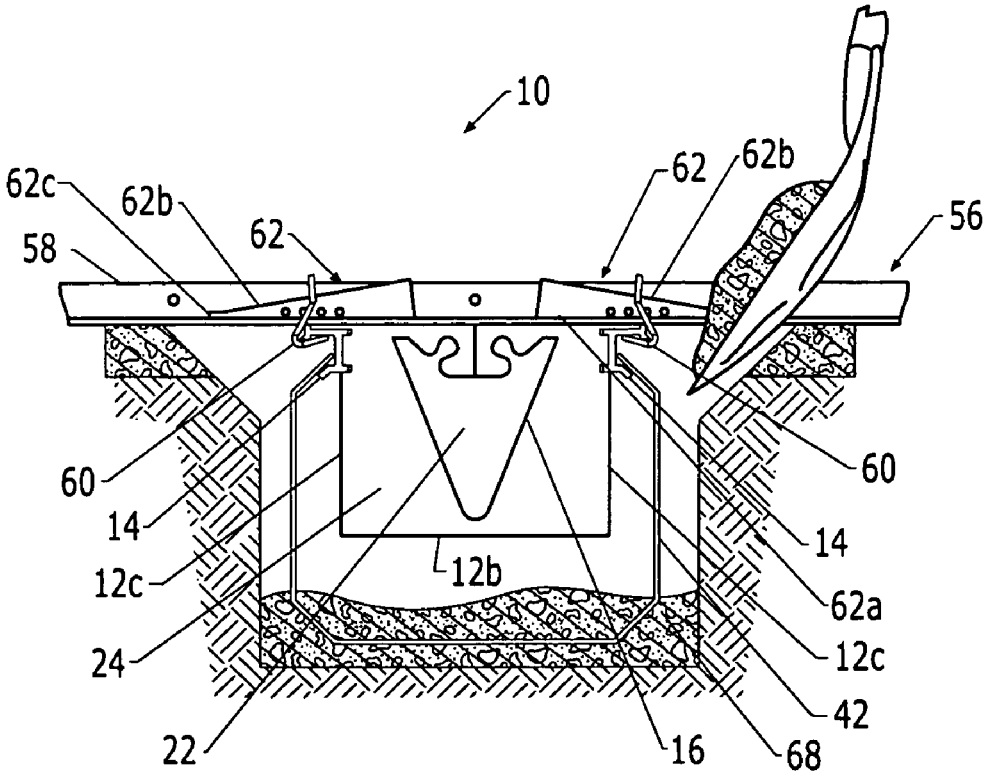
Figure 13:
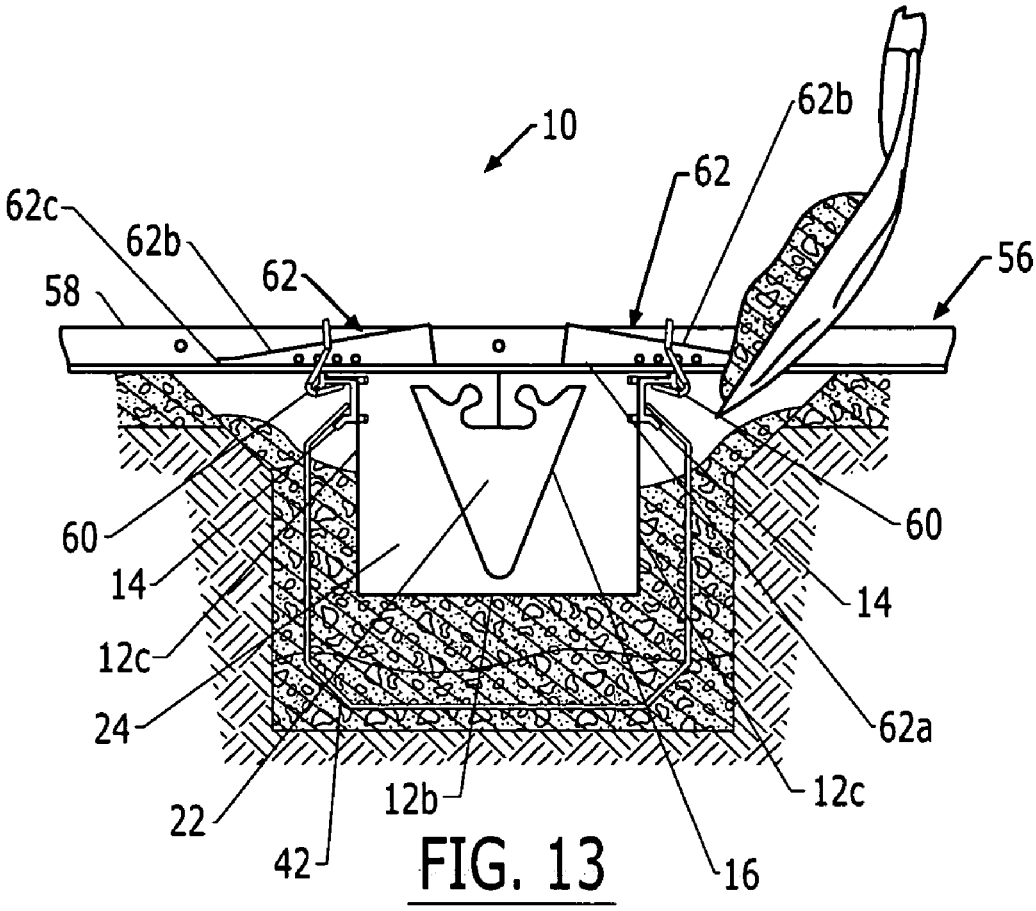
Figure 14:
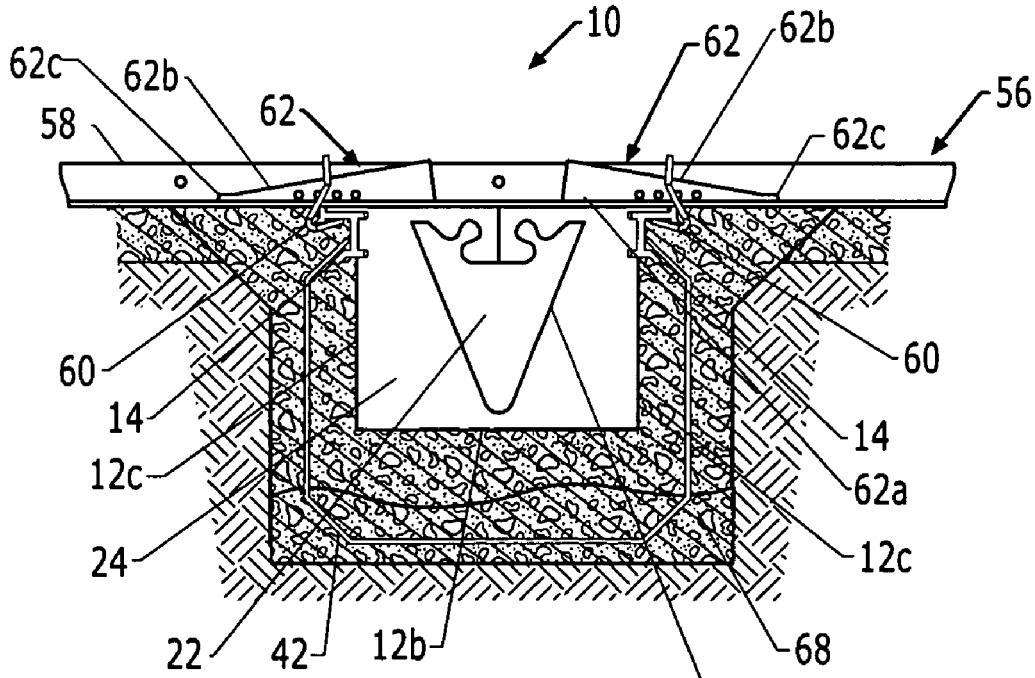
Figure 15:
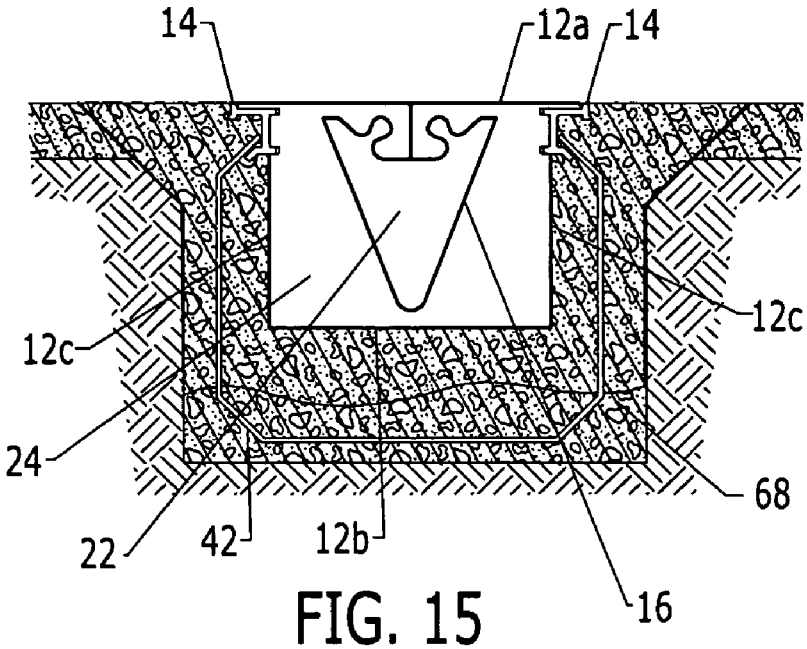
Figure 16:
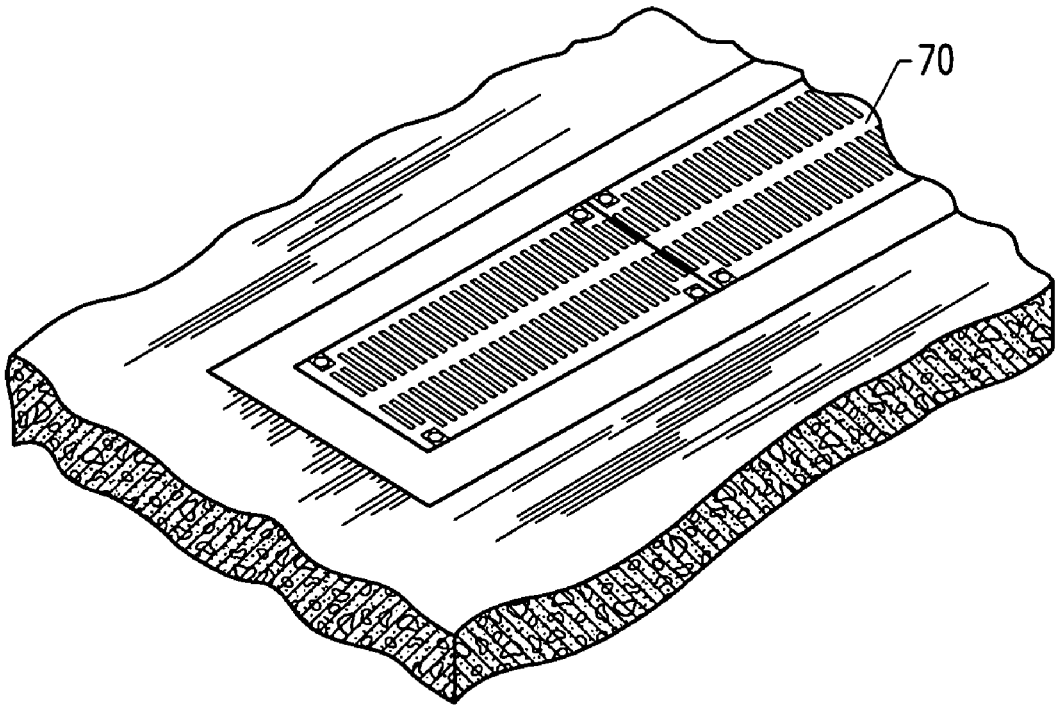

Having thus described the invention in general terms, reference will now be made to the accompanying drawings, which are not necessarily drawn to scale, and wherein:

FIG. 1 is an exploded perspective view of one embodiment of a section of a trench-forming assembly according to the present invention;

FIG. 2 is a perspective view of the section of the trench-forming assembly of FIG. 1 and illustrates placement and alignment of the trench-forming assembly in a preformed ditch;

FIG. 3 is a front view of the section of a trench forming assembly according to one aspect of the present invention;

FIG. 4A is a perspective view of the form body and frame members of one embodiment of the trench-forming assembly of the present invention;

FIG. 4B is a front elevational view of a portion of the form body and one frame member of one embodiment of the trench-forming assembly;

FIG. 5A is a perspective view of the form body and frame members of another embodiment of the trench-forming assembly of the present invention;

FIG. 5B is a front elevational view of a portion of the form body and one frame member of another embodiment of the trench-forming assembly;

FIGS. 6A and 6B are a front elevational view and perspective view, respectively, of a portion of a mounting-bracket assembly and one frame member according to one embodiment of the present invention before the hook member engages the frame member;

FIGS. 7A and 7B are a front elevational view and perspective view, respectively, of the portion of the mounting-bracket assembly and frame member of FIGS. 6A and 6B after the hook member engages the frame member;

FIGS. 8A and 8B are perspective views of another embodiment of the mounting bracket assembly of the present invention;

FIG. 9 is a front elevational view of a portion of the form body and one frame member of yet another embodiment of the mounting bracket assembly;

FIG. 10 is a perspective view of a mounting bracket of one embodiment of the present invention;

FIG. 11 is a cross-sectional view of the trench-forming assembly of one embodiment of the present invention following placement thereof in a preformed ditch;

FIG. 12 is a is a cross-sectional view of the trench-forming assembly of FIG. 11 during pouring of a subslab of moldable trench forming composition about a lower portion of the legs of the trench-forming assembly;

FIG. 13 is a is a cross-sectional view of the trench-forming assembly of FIG. 12 and illustrates a moldable trench forming composition being poured about the form body;

FIG. 14 is a is a cross-sectional view of the trench-forming assembly of FIG. 13 after a moldable trench forming composition has been poured about the form body but before the moldable trench forming composition has set;

FIG. 15 is a is a cross-sectional view of the trench-forming assembly of FIG. 14 after a moldable trench forming composition has been poured about the form body after the mounting bracket assembly as been removed and the moldable trench forming composition has set; and FIG. 16 is a perspective view of the trench according to one embodiment of the present invention following removal of the form body and placement of a trench cover on the support surfaces of the frame members.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1-3 illustrate a trench-forming assembly 10 for forming a trench of a predetermined shape. The trench-forming assembly can be utilized to form a trench for any of a number of different applications. For example, the trench-forming assembly can be used to form trenches for drainage systems in building floors facilities to collect, remove, and/or recycle excess water or other liquids. These trenches can also be used as utility chases to provide temporary or permanent routing of electrical lines, pipes, conduits or the like below the level of the building floor. In addition, the trench-forming assembly can be used to form trenches at any of a number of outdoor industrial and commercial sites, such as parking lots, to collect and direct rainwater and other liquids to underground storm sewers to prevent flooding and to decrease run-off. Also, for example, the trench-forming assembly can be used to form trenches for drainage of roadways and the like.

The trench-forming assembly includes an elongate form body 12 and a pair of frame members 14. The elongate form body includes a top surface 12*a*, a bottom surface 12*b*, and opposed side surfaces 12*c* for forming a moldable trench forming composition into a trench of predetermined shape. While the form body could be an integral body, the form body of the illustrated embodiment defines a meandering removal slot 16 extending throughout the form body.

The form removal slot 16 extends longitudinally from end to end of the form body 12. The slot extends upwardly into the form body in a divergent arrangement. Typically, the slots diverge in a vertical or upward direction such that the lateral spacing between corresponding horizontal portions thereof increases from a location proximate the bottom surface 12*b* of the form body towards the top surface 12*a*. Typically, the form removal slot defines an interior angle 25 (FIG. 3) of between about 5° and about 45°. As illustrated in FIG. 1, for example, the form removal slot 16 of this embodiment defines, in transverse cross-section, an interiorly located V-shaped wedge portion 22 of the form body. The V-shaped wedge portion is separated from corresponding lateral portions 24 of the form body 12 by the form removal slot 16. However, the form removal slot defines a pair of keys and keyways proximate the top surface for temporarily securing the V-shaped wedge portion to the lateral portions. As described below, the form body of the illustrated embodiment may be removed from a trench by destroying or otherwise removing an upper portion of the form body so as to disengage the V-shaped wedge portion from the lateral portions. In addition, the lateral portions of the illustrated embodiment are integrally joined together below the V-shaped wedge portion.

Advantageously, the removable elongate form body 12 includes means formed along the opposed side surfaces 12*c* for engaging the frame members 14 with the removable form. The engaging means are preferably provided in the form of one or more pairs of coplanar slots 38 that are generally arranged in a horizontal and coplanar manner, a top and bottom pair of which are shown and designated 38*a* and 38*b*. Preferably, the pairs of engagement slots are spaced above the bottom surface 12*b* of the form body and, most typically, are located proximate the top surface 12*a* of the form body. Such engagement slots 38 are discussed in detail in the aforementioned U.S. Pat. No. 5,281,051, which is incorporated herein by reference is hereby incorporated by reference. Various details disclosed in the incorporated '051 patent are not repeated herein for the sake of brevity. However, reference may be had to the incorporated '051 patent for such details. While the '051 patent describes, and the trench-forming assembly 10 of the present invention may include, a form body that defines a single pair of slots, the form body of the present invention generally defines two or more pairs of slots.

Each pair of frame member engagement slots 38 defined in the opposed side surfaces 12*c* of the form body 12 are advantageously coplanar for receiving and maintaining the frame members in a predetermined coplanar, spaced relationship above the bottom surface 12*b* of the form body. While the frame member engagement slots may extend into the first and second side walls by various amounts, the first and second frame member engagement slots 38 of each pair of one embodiment extend approximately ⅜ inch into the first and second side walls, respectively. Moreover, while one pair of frame member engagement slots may extend into the first and second side walls by a different amount than the other pair of frame member engagement slots, the frame member engagement slots of one embodiment all extend into the first and second side walls by the same amount.

The frame members 14 define a surface for supporting a trench cover 70 (shown in FIG. 16) and typically serve directly as a support surface for the trench cover. Alternatively, the frame members can function as shaping elements for shaping the hardenable trench forming composition into a pair of recesses for receiving a trench cover, in which case the frame members are removed to expose the trench cover receiving recesses following hardening of the trench forming composition. Further discussion of such removable frames members is provided in considerable detail in the incorporated '051 patent.

A preferred embodiment of the elongate frame members 14 is illustrated in FIG. 1 and, more particularly, in FIGS. 4A and 4B. In this embodiment, each frame member includes an elongate vertically oriented leg 40*a* and an elongate horizontally oriented leg 40*b* affixed along, or more preferably integral with, a top edge of the vertical leg. In this regard, the horizontal leg includes an engagement portion 40*c* and a support portion 40*d* that extend outwardly from the top edge of the vertical leg in opposing directions, where the engagement portion can be shorter than the support portion. In addition, the support portion preferably includes an end member

40*e* having an edge portion 40*f* and a base portion 40*g* that is preferably sloped. The edge portion of the end member is affixed along, or more preferably integral with, an edge of the support portion opposite the engagement portion of the horizontal leg such that the base portion of the end member extends outwardly in a direction opposite the support portion of the horizontal leg. Thus, the base portion is oriented such that the base portion tapers from a thicker portion proximate the edge portion to a thinner portion.

The elongate horizontal legs 40*b* and, in particular, the engagement portion 40*c* of the horizontal legs, are adapted for insertion in the top pair of longitudinal frame member engagement slots 38*a*. Each horizontal leg is also adapted to define a support surface for supporting the trench cover 70 placed over the resulting trench. The vertical leg 40*a* contacts the form body 12 upwardly along a side surface 12*c* thereof following engagement of the frame member into the alignment slot. Each frame member also preferably includes a securing leg 40*h* affixed along, or more preferably integral with, a bottom edge of the vertical leg. The securing leg includes an engagement portion 40*i* that extends inwardly from the bottom edge of the vertical leg and a connecting portion 40*j* that extends outwardly and/or downwardly from the bottom edge of the vertical leg in an opposing direction from the engagement portion. The engagement portions of the securing legs are adapted for insertion in the bottom pair of frame member engagement slots 38*b*.

As best shown in FIG. 4B, the engagement portions 40*c* and 40*i* of the horizontal and securing legs 40*b* and 40*h*, respectively, are vertically spaced apart from one another. While the engagement portions may be spaced apart by different amounts, the engagement portions of one embodiment are spaced apart by approximately 1.25 inches. As also best shown in FIG. 4B, the upper surface of the engagement portion of the horizontal leg is generally spaced somewhat below the uppermost portion of the edge portion 40*f* of the end member 40*e*, such as by about 0.375 inches in one embodiment. As such, a relatively thin section of the form body 12 extends over and is supported by the horizontal leg. In the absence of further engagement, i.e., engagement other than that provided by the engagement portion of the horizontal leg, the relatively thin section of the form body might fracture in instances in which the weight of the entire form body had to be supported by the thin section. As such, the engagement portion of the securing leg also engages the form body at a location spaced from that of the engagement portion of the horizontal leg, thereby permitting the forces incident upon the form body to be supported by additional portions of the form body.

Whereas the frame members 14 can be made from any of a number of different materials, in one embodiment the frame members are made from aluminum. And in one advantageous embodiment, the frame members, including the vertical leg 40*a*, horizontal leg 40*b*, the end member 40*e*, and the securing leg 40*h*, are all preferably integral with one another. Additionally, the frame members advantageously have the same profile along their entire length. As such, the frame members can be fabricated by extruding molten aluminum through a die or the like. As such, the frame members need not be fabricated according to multiple steps of fabricating the individual components and thereafter affixing the components to one another, as required by conventional techniques.

Affixed to the frame members 14, the trench-forming assembly 10 can also include a plurality of anchoring legs 42 extending downwardly from the frame members (shown in FIG. 1). The anchoring legs can be affixed to the frame members in any one of a number of different manners, such as by securing the anchoring legs to the frame members by means of screws, rivets or the like. As subsequently discussed, the anchoring legs are adapted to anchor the form body in a subslab 68 (shown in FIG. 12) of moldable trench forming composition poured around the lower portion of each of the legs and below the bottom surface 12*b* of the form body. These anchoring legs further facilitate the retention of the frame members 14 within the trench formed of hardenable trench forming composition. As shown in FIG. 2, the anchoring legs can be positioned at ends of the frame members so as to overhang respective ends. In this regard, the anchoring legs can also be used to interconnect multiple sections of frame members of the trench-forming assembly. However, the trench-forming assembly may include a different number of anchoring legs and/or anchoring legs at different positions along the frame members.

In an alternative embodiment of the elongated frame members 14, shown in FIGS. 5A and 5B, each frame member includes an elongate vertically oriented leg 40*k* and an elongate horizontally oriented leg 40*l* affixed along and, more preferably, integral with a top edge of the vertical leg such that the horizontal leg and vertical leg form a T-shaped assembly. The horizontal leg includes an engagement portion 40*m* and a support portion 40*n* that extend outwardly from the top edge of the vertical leg in opposing directions, where the engagement portion can be the same or a different length than the support portion. In addition, the support portion preferably includes a vertically oriented lip member 40*o* affixed, such as by welding or the like, along an edge of the support portion opposite the engagement portion of the horizontal leg.

The horizontal legs 40*l* of the embodiment illustrated in FIGS. 5A and 5B are adapted for insertion in the frame member engagement slots 38 defined by the form body 12. As shown in FIG. 5B, a thicker portion of the form body is supported by the horizontally oriented leg than in the embodiment depicted in FIGS. 1-4, 6-7, 9, and 11-15. As such, while the frame member could include another engagement portion spaced vertically from the engagement portion 40*m* of the horizontally oriented leg for additionally engaging the form body, a single pair of engagement portions is generally sufficient for the trench-forming assembly 10 depicted in FIGS. 5A and 5B.

The horizontal leg 40*l* also is adapted to define a support surface for supporting the trench cover 70 placed over the resulting trench. The vertical leg 40*k* contacts the form body upwardly along a side surface 12*c* thereof following engagement of the frame member into the alignment slot. The trench-forming assembly 10 of this embodiment also typically includes a plurality of anchoring legs 44 extending downwardly therefrom. The anchoring legs are preferably affixed to the frame members via L-shaped brackets 46 that may, in turn, be affixed to a bottom edge of the vertical leg opposite the horizontal leg. To affix the anchoring legs, then, the anchoring legs can be extended partially through holes in the L-shaped brackets and secured thereto, such as by means of a nut 48.

In the embodiment illustrated in FIGS. 5A and 5B, the frame members 14 can also include a plurality of additional anchors 50, otherwise known as Nelson studs, extending outwardly and downwardly from both of the frame members 14 at longitudinally spaced locations therealong. These anchors are adapted to extend into and be engaged by the hardenable trench forming composition poured about the removable form. These additional anchors further facilitate the retention of the frame members 14 within the trench formed of hardenable trench forming composition.

It should be noted that the shape of the form body 12 and, particularly the top surface 12*a* of the form body, can vary depending upon the configuration of the frame members 14, or vice versa. In this regard, the form body illustrated with the embodiment of the frame members depicted in FIGS. 1, 4A and 4B generally includes a flat top surface except where the form removal slot 16 reaches the top surface. In this regard, the top surface of the form body typically does not extend above a plane defined by the uppermost portion of the frame members or, more particularly, the top edges of the end members 40*e* of the frame members. In contrast, the form body illustrated with the alternative embodiment of the frame members depicted in FIGS. 5A and 5B extends above a plane defined by the uppermost portion of the frame members or, more particularly, the top edges of the lip members 40*o*. As such, to aid in aligning the form member in such embodiments, the form body may include a central recess 52 of substantially rectangular cross-section of a predetermined size. The central recess extends longitudinally along the top surface and is preferably sized to receive an alignment member (not shown) of like cross-section. In addition, the top surface can include one or more laterally extending cross recesses 54, also of substantially rectangular cross-section of a predetermined size. In this regard, the cross recesses are preferably sized to receive mounting brackets 58, as shown in FIGS. 1-3, and described below. In the embodiment in which the form body does not extend above the frame members, the form body need not include laterally extending cross recesses.

As indicated in the background section, the anchoring legs 42, 44 of the trench-forming assembly 10 generally maintain the frame members 14 in position with respect to one another. However, the frame members are typically still capable of moving somewhat with respect to one another. To limit such movement, conventional trench forming assemblies include one or more tie wires wrapped about the opposed frame members so as to bring the frame members into snug contact with the opposite sides of the form body 12. Once the cementitious material has sat and the frame members are correspondingly affixed in position, the tie wires can be removed prior to removing the form to expose the resulting trench.

Again referring to FIGS. 1-3, in contrast to utilizing tie wires in a conventional trench-forming assembly, the trench-forming assembly 10 of embodiments of the present invention includes one or more mounting bracket assemblies 56 to thereby improve the manner in which the frame members 14 are secured to the form body 12. In this regard, the mounting bracket assembly extends between opposed frame members so as to maintain the alignment and, to some degree, the relative position of the opposed rails. The mounting bracket assembly typically extends across the drainage channel and includes a hook member for engaging each of the rails. According to one embodiment, the mounting bracket assembly includes an L-shaped mounting bracket 58. In this regard, the mounting bracket includes an elongate horizontally oriented leg 58*a* and an elongate vertically oriented leg 58*b* affixed along, or more preferably integral with, an edge of the vertical leg. The horizontal leg 58*a* of the mounting bracket 58 is generally adapted to contact the form body 12 along a top surface 12*a* thereof following engagement of the frame members 14 to the form body, and following engagement of the mounting bracket assembly 56 to the frame members, as described below. Alternatively, the mounting bracket may have other shapes so long as the mounting bracket bridges between the frame members.

In addition to the mounting bracket 58, the mounting bracket assembly 56 preferably includes a pair of securing members. In one embodiment, the securing members comprise hook members 60 that each include an arm portion 60*a* and a hook portion 60*b*, as seen more particularly in FIGS. 6 and 7. The hook members can comprise any of a number of different devices but, in one embodiment, the hook members comprise wedge bolts bent at one end to thereby form the hook portions. The arm portion of each hook member extends at least partially through a respective aperture 58*c* defined by the mounting bracket, such as the horizontal leg of an L-shaped mounting bracket. The hook portions are also disposed such that the hook portions of each hook member faces the other such that the hook members can engage respective frame members 14, such as by engaging the bottom surface of the horizontal leg 40*b*, as shown in FIGS. 7A and 7B.

The mounting bracket assembly 56 can include a pair of tension members capable of urging the hook members 60 into contact with respective frame members 14. In one embodiment, each hook member defines a slot 60*c* at least partially therethrough, where the slot extends lengthwise along the arm portion 60*a* of the hook, and where the slots of the hook members face one another. The tension members of this embodiment of the mounting bracket assembly 56 can comprise a pair of wedge members 62 that extend through the slots when the hook members engage respective frame members. Each wedge member of the illustrated embodiment includes a base edge 62*a* and an angled edge 62*b* that extends upward from a first end 62*c* of the wedge member at an acute angle toward a second end 62*d*. The base edges 62*a* of the wedge members 62 are capable of slidably resting on the horizontal leg 58*a* of the mounting bracket 58. In the illustrated embodiment, the wedge members slidably rest on the horizontal leg such that the second ends of the wedge members face one another. It should be understood, however, that the wedge members can slidably rest on the horizontal leg such that the first ends of the wedge members face one another without departing from the spirit and scope of the present invention.

Irrespective of the manner in which the wedge members 62 rest on the horizontal leg 58*a* of the mounting bracket 58, the first end 62*c* of each wedge member is capable of extending through the slot 60*c* of a respective hook member 60 in varying amounts. In this regard, prior to extending the first end of the wedge member through the slot of the hook member, or after extending the first end through the slot a short distance, the hook member can move about within the aperture 58*c* defined by the mounting bracket. The hook portion 60*b* of the hook member can then be positioned underneath the bottom surface of the horizontal leg 40*b* of a respective frame member 14, as shown in FIGS. 6A and 6B. In this stage, however, the hook member is still loose relative to the frame member. Next, the first end of the wedge member can be extended through the slot defined by the hook member. The upper end of the slot defined by the hook member rides up on the angled edge of the wedge member as the hook member is driven upward through the aperture defined by the mounting bracket. As the hook member is driven upward, the hook portion of the hook member can be snugly secured underneath the bottom surface of the horizontal leg of the respective frame member to thereby hold the respective frame member in place with respect to the mounting bracket 58, as shown in FIGS. 7A and 7B.

The wedge members 62 can define one or more holes 62*e* therethrough such that pins, rivets or the like can be inserted through one of the holes and a corresponding hole (not shown) defined through the vertical leg 58*b* of the mounting bracket 58. In this regard, once the hook members 60 snugly engage the frame member the wedge members can be secured in place relative to the hook members to hold the hook members in place relative to respective frame members 14 by inserting a pin, rivet or the like through a hole in the wedge member on the side of the hook member 60 closest to the first end 62*c* of the wedge member. Additionally, or alternatively, the wedge members can be held in place by frictional forces between the wedge members and respective hook members, and between the wedge members and the horizontal leg 58*a* of the mounting bracket, where the frictional forces are imparted by extending the first end 62*a* of the wedge members through the slots 60*c* defined by respective hook members as far as possible while the hook portions 60*b* of the hook members engage the bottom surface of the horizontal legs 40*b* of respective frame members. Thus, the hook members permit the mounting bracket to be removably attached to the frame members. It will be appreciated, however, that the hook members may permit some relative longitudinal movement of the frame members after the hook members have engaged the frame members.

The hook members may have various configurations. As shown in FIGS. 8A and 8B, in an alternative embodiment of the mounting bracket assembly 56 (illustrated with a portion of the alternative embodiment of the frame members 14 as illustrated in FIG. 5), the mounting bracket assembly includes a pair of hook members 64 that each include an arm portion 64*a* and a hook portion 64*b*. The arm portion of the hook members can be pivotably secured to the mounting bracket 58 or, more particularly, the vertical leg 58*b* of the mounting bracket. The arm portion of each hook member is preferably pivotably secured to the vertical leg of the mounting bracket on a side of the vertical leg opposite the horizontal leg 58*a* of the mounting bracket. In addition, the hook members are disposed such that the hook portions of the hook members face one another such that the hook members can engage respective frame members 14 on a bottom surface of the horizontal leg 40*l*. The hook portions of the hook members can therefore pivot underneath the lip member 40*o* of the support portion 40*n* of the horizontal leg 40*l* after the mounting bracket engages the top surface 12*a* of the form body 12. As such, the mounting bracket of this embodiment can also securely engage the frame members when the frame members engage the form body to thereby prevent the frame members from being displaced.

In yet another embodiment of the mounting bracket assembly 56, shown in FIG. 9, the mounting bracket includes a pair of hook members 66, each comprised of an L-shaped member 66*a* including a horizontally oriented portion 66*b* affixed to the horizontal leg 58*a* of the mounting bracket 58, and a vertically oriented portion 66*c* extending downwardly from an edge of the horizontal portion of the L-shaped member. The L-shaped members of the hook members are affixed to the horizontal leg of the mounting bracket on a side of the horizontal leg opposite the vertical leg 58*b* of the mounting bracket. In addition, the L-shaped members are spaced apart at a distance approximately equal to, or slightly smaller than, the distance between the outermost tips of the base portions 40*g* of the end member 40*e* of the frame members 14 when the frame members have engaged the form body 12. In this regard, the mounting bracket can engage the form body while the L-shaped members extend downward along the outermost edge of the frame members.

To secure the mounting bracket assembly 56 to the frame members 14 when the mounting bracket 58 contacts the top surface 12*a* of the form body 12, each hook member 66 also includes a button member 66*d* affixed to a side of the vertical portion 66*c* of the L-shaped member 66*a* such that the button members of the L-shaped members face one another. The hook members, then, are adapted such that the vertical portion of the L-shaped member can resiliently bend or flex as the mounting bracket is moved downward toward the top surface 12*a* of the form body, and as the button members contact the base portion 40*g* of the end member 40*e* of a respective frame member 14. The L-shaped member 66*a* can then return to its original form as the mounting bracket contacts the top surface of the form body and the button members snap underneath the base portion 40*g* of the end member. Thus, by snapping the button members underneath the base portion of the end member of the respective frame member, the mounting bracket can be securely engaged to each frame member when the frame members are engaged with the form body to thereby prevent the frame members from being displaced.

The mounting bracket 58 can also include features for engaging the frame members 14 and, in particular, the horizontal leg 40*b* of the frame members, thereby preventing the horizontal legs of the frame members from tilting or otherwise becoming misaligned as the mounting bracket is secured thereto. As seen more particularly in FIG. 10, the mounting bracket can define a pair of apertures 58*c* spaced apart from one another at a distance approximately equal to the distance between the top edges of the end members 40*e* of the frame members. The horizontal leg of the mounting bracket can also include a pair of downturned bias members 58*d* that extend downward and, in the illustrated embodiment, are disposed proximate or within respective apertures. The bias members extend downward by an amount approximately equal to the distance between the uppermost portion of the frame member, such as the end member, and the horizontal leg. When the mounting bracket contacts the form body, then, the downturned bias members are capable of effectively contacting respective frame members upon the horizontal leg and the end member of respective frame members, as shown in FIGS. 7 and 8. By effectively contacting the horizontal leg, it is contemplated that the downturned bias member may physically contact the horizontal leg or may indirectly contact the horizontal leg by having a compressed portion of the form body between the downturned bias member and the horizontal leg capable of transmitting force therebetween. The downturned bias members therefore insure that the upwardly facing horizontal legs 40*b* remain coplaner to support of the grate.

Each mounting bracket 58 may extend laterally beyond the form body 12 by some distance, as shown in FIGS. 1-3. In this regard, the mounting brackets can extend over a prepared ditch such that the form body and frame members 14 can be placed into the prepared ditch by suspending the form body and frame members from the mounting brackets, as shown in FIG. 2. To secure the mounting brackets and, thus, the trench-forming assembly in position with respect to the prepared ditch, opposite ends of the mounting brackets and, in particular, the vertical legs 58*b* of the mounting brackets can define one or more holes 58*e*. The mounting brackets can therefore be connected to batterboards, stakes, rebar or the like via fasteners, brackets or the like extended through the holes such that the form body and the frame members can be suspended within the trench from the mounting brackets. The mounting bracket may also define one or more holes in the opposite ends of the horizontal leg 58*a* to permit the mounting bracket to be secured to a floor or other surface by means of fasteners or the like extending through the holes.

FIGS. 2, and 11-16 illustrate use of the trench forming assemblies 10 of the invention. In use, the elongate form assembly is placed in a predetermined location, such as a preformed ditch. The form assembly preferably includes frame members 14, an elongate form body 12, frame member engagement slots 38 defined by the opposed side surfaces 12*c* of the form body for engaging the frame members 14 with the removable form and, in some embodiments, a removal slot 16 extending throughout the form body. As previously explained, the form removal slot preferably extends upwardly above the frame members to define, in transverse cross-section, a V-shaped wedge portion 22 of the form body that separates corresponding lateral portions 24. In turn, the lateral portions are integrally joined by at least a portion of the bottom surface 12*b* of the form body.

Prior to placement of the form assembly in the preformed ditch, the mounting brackets 58 typically extends laterally across the top surface 12*a* of the removable form body 12 and engages the opposed frame members as described above. The mounting brackets can then be affixed to the ground by means such as wooden stakes, nails, screws, rebar or the like (not shown), so that the form assembly is held or suspended in a fixed relation within the ditch. Thus, the form assembly may be properly aligned by appropriately positioning the mounting brackets with respect to the ditch.

The elongate form assembly is thereafter anchored in the ditch. Preferably, the form assembly is anchored by pouring a subslab 68 of hardenable trench forming composition, such as concrete, in the ditch. The subslab is poured about a lower end of a plurality of legs 42 and below the bottom surface of the form body 12 as illustrated in FIG. 12. Once the subslab has hardened or set, the frame members 14, as well as the form body engagedly retained by the frame members, are held in a fixed relation with the ditch.

Subsequently, additional hardenable trench forming composition is poured between the bottom 12*b* and opposed side surfaces 12*c* of the removable form and the earthen walls of the ditch. In the embodiment illustrated in FIGS. 13 and 14, the trench forming composition preferably fills the ditch about the form body 12 up to the uppermost portion of the end member 40*e* of the support portion 40*d* of the elongate horizontal leg 40*a* of the frame members 14.

After the hardenable trench forming composition has been poured, but before the hardenable trench forming composition has hardened or set, the mounting bracket assemblies 56 can be removed from the frame members 14 and, thus, the elongate form assembly. In this regard, the hook members for securing the mounting brackets to the frame members can be removed from the frame members, such as by reversing the manner in which the respective hook members were secured to the frame members. Thereafter, any gaps in the trench forming composition created by removing the hook members can be smoothed over or otherwise filled in with additional hardenable trench forming composition. Also after the mounting bracket assemblies have been removed, the portions of the mounting bracket assemblies that have been exposed to the hardenable trench forming composition can be cleaned such that the mounting bracket assembly can be reused with other form assemblies. To aid in cleaning the mounting bracket assemblies, the mounting bracket assemblies can be pre-treated with any of a number of well known "form release" chemicals prior to being exposed to the hardenable trench forming composition.

Once the hardenable trench forming composition has hardened or set, the elongate form body 12 is removed. More particularly, the elongate form body is removed by first removing the V-shaped wedge portion 22 formed by the form removal slot 16 and then removing the corresponding lateral portions 24 of the form body. The V-shaped wedge portion is preferably removed by severing at least a portion of the top surface 12*a* of the form body which joins the corresponding lateral portions. Following severance of those portions of the top surface, the V-shaped wedge portion may be removed. Once the V-shaped wedge portion has been removed, the portion of the bottom surface integrally joining the lateral portions can be severed. Thereafter, the lateral portions may be disengaged from the top and bottom longitudinal slots 38*a*, 38*b* in the form body and removed from the trench.

After removing the form body 12, a trench cover 70, such as a grate, may be placed upon a support portion of the coplanar horizontally elongate legs 40*a* of frame members 14. In preferred embodiments, the thickness of the trench cover 38 preferably equals the height of the end member 40*e* above the support portion 40*d* of the elongate horizontal leg 40*a* of the frame members 14. Therefore, the upper surface of the trench cover can lie flush with the surrounding ground and the upper edges of the trench.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of fabricating a longitudinal frame member of a trench-forming assembly to be used to form a trench and to support a trench cover, said method comprising:

providing a molten material; and extruding the molten material through a die shaped to define the frame member to comprise a vertical leg, a horizontal leg and a securing leg integral with opposite edges of the vertical leg, and an end member integral with an edge of the horizontal leg, wherein the horizontal leg comprises an engagement portion and a support portion that extend outwardly from a top edge of the vertical leg in opposite directions, and wherein the support portion and the engagement portion of the horizontal leg of the frame member are structured to support one side of a longitudinal form body during the formation of the trench and one side of the trench cover subsequent to formation of the trench, and wherein the securing leg comprises an engagement portion and a connecting portion that extend outwardly from a bottom edge of the vertical leg in opposite directions, and wherein the connecting portion extends outwardly and downwardly from the bottom edge of the vertical leg in a direction that is not parallel with the horizontal leg.

2. A method according to claim 1, wherein extruding the molten material comprises extruding the molten material through a die shaped to define the end member to comprise an edge portion and a base portion, wherein the base portion extends outwardly from the edge portion of the end member.

3. A method according to claim 2, wherein extruding the molten material comprises extruding the molten material through a die shaped to define the base portion of the end member so that the base portion tapers from a thicker portion proximate the edge portion of the end member to a thinner portion.

4. A method according to claim 2, wherein extruding the molten material comprises extruding the molten material through a die shaped to define the frame member so that an upper surface of the engagement portion of the horizontal leg is vertically spaced below the upper portion of the edge portion of the end member.

5. A method according to claim 1, wherein extruding the molten material comprises extruding the molten material through a die shaped to define the frame member so that the engagement portion of the horizontal leg and the end member are integral with opposite edges of the support portion of the horizontal leg.

6. A method according to claim 1, wherein the molten material comprises aluminum.

7. A method according to claim 1, further comprising:

forming one or more apertures in the connecting portion of the securing leg for connecting, via one or more fasteners, an anchoring leg of the trench-forming assembly to the connecting portion of the securing leg.

* * * * *